US010125448B2

(12) United States Patent
Seo et al.

(10) Patent No.: US 10,125,448 B2
(45) Date of Patent: Nov. 13, 2018

(54) WASHING MACHINE

(71) Applicant: LG ELECTRONICS INC., Seoul (KR)

(72) Inventors: Bosung Seo, Seoul (KR); Myunghun Im, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 16 days.

(21) Appl. No.: 14/637,023

(22) Filed: Mar. 3, 2015

(65) Prior Publication Data

US 2015/0252513 A1 Sep. 10, 2015

(30) Foreign Application Priority Data

Mar. 4, 2014 (KR) ..... 10-2014-0025733
Mar. 4, 2014 (KR) ..... 10-2014-0025746
Mar. 4, 2014 (KR) ..... 10-2014-0025747

(51) Int. Cl.
*D06F 39/02* (2006.01)
*D06F 39/08* (2006.01)

(52) U.S. Cl.
CPC ..... *D06F 39/028* (2013.01); *D06F 39/022* (2013.01); *D06F 39/08* (2013.01); *D06F 2202/02* (2013.01); *D06F 2202/085* (2013.01); *D06F 2204/02* (2013.01)

(58) Field of Classification Search
CPC ..... D06F 39/022; D06F 39/02; D06F 39/028; D06F 39/08; D06F 39/083; D06F 39/088
See application file for complete search history.

(56) References Cited

U.S. PATENT DOCUMENTS 4,889,644 A 12/1989 Amberg et al.
5,345,637 A * 9/1994 Pastryk ..... D06F 35/006 68/148
2008/0229790 A1 9/2008 Kim et al.
2009/0235962 A1* 9/2009 Classen ..... A47L 15/4454 134/57 D
2010/0107704 A1 5/2010 Seo et al.
2011/0154865 A1 6/2011 Lee et al.
2011/0174021 A1 7/2011 Lee et al.
2011/0186098 A1 8/2011 Hasse et al.
2012/0006077 A1 1/2012 Mun et al.
(Continued)

FOREIGN PATENT DOCUMENTS

CN 101652513 A 2/2010
CN 101725015 A 6/2010
(Continued)

*Primary Examiner* — Spencer E Bell
(74) *Attorney, Agent, or Firm* — Dentons US LLP

(57) ABSTRACT

A washing machine including a cabinet having with an inlet port formed at a front panel for laundry insertion thereinto and a door to open or close the inlet port; a tub within the cabinet for storing wash water; a drum in communication with the inlet port, and rotatably provided within the tub; a detergent dispenser provided below the inlet; a water passage to supply wash water from a water source to at least one of the tub and the detergent dispenser; and a connecting passage to connect the tub and the detergent dispenser for transfer of the wash water stored in the tub to the detergent dispenser and for transfer of the detergent stored in the detergent dispenser to the tub.

24 Claims, 18 Drawing Sheets

(56) References Cited

U.S. PATENT DOCUMENTS

| | | | |
|---|---|---|---|
| 2012/0103028 | A1 | 5/2012 | Lee et al. |
| 2013/0302137 | A1 | 11/2013 | Meessmann et al. |
| 2013/0312463 | A1 | 11/2013 | Kim et al. |

FOREIGN PATENT DOCUMENTS

| | | | |
|---|---|---|---|
| CN | 102127853 | A | 7/2011 |
| CN | 102345223 | A | 2/2012 |
| CN | 202744826 | U | 2/2013 |
| CN | 202913249 | U | 5/2013 |
| CN | 103422328 | A | 12/2013 |
| CN | 203374479 | U | 1/2014 |
| EP | 0096260 | A1 | 12/1983 |
| EP | 1884584 | A2 | 2/2008 |
| EP | 2476792 | A2 | 7/2012 |
| EP | 2479335 | A1 | 7/2012 |
| EP | 2666900 | A1 | 11/2013 |
| JP | 2011-041586 | A | 3/2011 |
| KR | 1020090122004 | A | 11/2009 |
| KR | 10-2010-0065589 | A | 6/2010 |
| KR | 10-2013-0010800 | A | 1/2013 |
| KR | 10-1343712 | A | 8/2013 |
| KR | 10-1343712 | B1 | 12/2013 |
| WO | 2015022622 | A1 | 2/2015 |

* cited by examiner

WASHING MACHINE

CROSS-REFERENCE TO RELATED APPLICATIONS

This application claims the benefit of Korean Patent Application Nos. 10-2014-0025746, 10-2014-0025733, and 10-2014-0025747, all filed on Mar. 4, 2014, each of which is hereby incorporated by reference for all purposes as if fully set forth herein.

BACKGROUND

1. Field

The present disclosure relates to a washing machine, and more particularly, to a washing machine provided with a detergent dispenser.

2. Description of the Related Art

Generally, a washing machine is an apparatus for putting laundry and wash water into a drum and then removing contaminants adhered to the laundry through an interaction between the laundry and the wash water while rotating the drum. During the process, various additives for enhancing washing power and protecting laundry may be used together therewith. Representative additives may include detergent or various fabric softeners, and the like.

Such detergent or various fabric softeners (hereinafter, referred to as "detergent") may be directly injected into wash water by a user, but may also be supplied through a detergent supply apparatus provided in a washing machine. The detergent supply apparatus may be mounted on a front surface or upper surface of the washing machine to allow the injected detergent to be supplied into the drum along with wash water.

Specifically, when a user injects an adequate amount of detergent into an input space provided in the detergent supply apparatus, wash water supplied to the drum passes through the input space, thereby allowing wash water together with the detergent to be supplied to the drum.

Such a conventional washing machine requires a space for providing a passage at an upper portion of the drum of the washing machine in which a passage for supplying wash water to the drum from the input space is additionally provided. Furthermore, when a door is installed on a front surface thereof, a detergent supply apparatus is mounted on an upper surface of the washing machine, and the door is mounted below the detergent supply apparatus, and thus the height of the door is low. Accordingly, there is a problem in which it is inconvenient for the user to open the door and put laundry into the drum.

Furthermore, a washing machine with the foregoing structure may bring inconvenience for the user in determining an adequate amount of detergent as well as supplying the detergent for each washing cycle. In order to solve this problem, a type of detergent supply apparatus in which a large amount of detergent is stored to supply an adequate amount of detergent for each washing cycle is taken into consideration. However, due to the characteristics of powder detergent, when it is brought into contact with moisture, there is a problem in which detergent powder particles agglomerate together to clog the inlet.

SUMMARY

One object is to provide a washing machine for facilitating the input of laundry by moving the installation position of a detergent dispenser to a lower portion of a door, and moving the position of a laundry inlet in an upward direction.

Another object is to provide a washing machine capable of automatically supplying detergent into a drum without manually injecting detergent by a user for each washing cycle.

Still another object is to provide a washing machine capable of preventing the agglomeration phenomenon of detergent powder or the like.

In order to accomplish such an object of the present disclosure, a washing machine according to the present disclosure may include a cabinet having an inlet port formed at a front panel for laundry insertion thereinto and a door to open or close the inlet port; a tub within the cabinet for storing wash water; a drum in communication with the inlet port, and rotatably provided within the tub; a detergent dispenser provided below the inlet; a water passage to supply wash water from a water source to at least one of the tub and the detergent dispenser; and a connecting passage to connect the tub and the detergent dispenser to transfer wash water stored in the tub to the detergent dispenser and transfer detergent stored in the detergent dispenser to the tub.

According to an example associated with an object of the present disclosure, the inlet port may be disposed to be biased in an upward direction from a front portion of the cabinet.

According to an example associated with an object of the present disclosure, the tub may be disposed to be inclined to a bottom surface of the cabinet such that the height of the front surface is located higher than that of the rear surface.

According to an example associated with an object of the present disclosure, the detergent dispenser may include a dispenser case having an opening portion on an upper surface thereof; and a detergent supply unit mounted on the dispenser case to store detergent therein.

According to an example associated with an object of the present disclosure, the dispenser case may be rotatably provided on a front portion of the cabinet, and rotates between an opening position at which the opening portion is exposed to the outside and an accommodation position at which the opening portion is accommodated into the cabinet.

According to an example associated with an object of the present disclosure, the dispenser case may form the whole of a lower panel located lower than the inlet port on a front panel of the cabinet.

According to an example associated with an object of the present disclosure, the dispenser case may form part of a lower panel located lower than the inlet port on a front panel of the cabinet.

According to an example associated with an object of the present disclosure, the dispenser case may include a front plate to open or close an accommodation hole into which detergent dispenser is accommodated; a lateral plate extended from both end portions of the front plate in a backward direction; and a hinge shaft formed at a lower end portion of the lateral plate and coupled to the cabinet such that an upper end portion of the front plate is allowed to rotate in a forward or backward direction.

According to an example associated with an object of the present disclosure, the detergent supply unit may be detachably mounted at an open position of the dispenser case.

According to an example associated with an object of the present disclosure, the dispenser case may be provided with a guide groove formed with a predetermined curvature on the lateral plate to constantly maintain an open angle of the front plate.

According to an example associated with an object of the present disclosure, the detergent supply unit may include at least one of a manual detergent supply unit and an automatic supply unit.

According to an example associated with an object of the present disclosure, a pump module may be provided within the cabinet, and the pump module may include at least one of a circulation pump to circulate wash water or wash water mixed with detergent to the tub; and a drain pump to discharge wash water or wash water mixed with detergent that has passed through the tub to an outside of the cabinet.

According to an example associated with an object of the present disclosure, the connecting passage may include at least one of a first detergent supply passage to connect the detergent dispenser and a bottom surface of the tub to supply detergent from the detergent dispenser to the bottom surface of the tub; and a second detergent supply passage to connect the detergent dispenser and the remaining part of the tub to supply detergent from the detergent dispenser to the remaining part of the tub excluding the bottom surface of the tub.

According to an example associated with an object of the present disclosure, the water passage may include at least one of a first water passage to connect the water source and the tub to supply wash water from the water source to the tub; and a second water passage to connect the water source and the detergent dispenser to supply wash water from the water source to the detergent dispenser, wherein the a water valve is provided in at least one of the first water passage and second water passage.

According to an example associated with an object of the present disclosure, a detergent inlet port may be provided on a bottom surface of the tub to flow detergent thereinto.

According to an example associated with an object of the present disclosure, detergent in at least one of the automatic detergent supply unit and the manual detergent supply unit may be supplied to the bottom surface of the tub through the first detergent supply passage.

According to an example associated with an object of the present disclosure, detergent in at least one of the automatic detergent supply unit and the manual detergent supply unit may be supplied to the remaining part of the tub through the second detergent supply passage.

According to an example associated with an object of the present disclosure, the first detergent supply passage may include a backflow prevention device to block wash water discharged from the tub entering to the detergent dispenser.

According to an example associated with an object of the present disclosure, the first water passage may be disposed at a higher position than the backflow prevention device.

According to an example associated with an object of the present disclosure, wash water supplied from the water source to the tub may be supplied through the second water passage to fill the level of the tub up to a height of the backflow prevention device, and then supplied through the first water passage.

According to an example associated with an object of the present disclosure, the washing machine may further include a drain passage to connect the tub, the drain pump, and an outside of the cabinet in order to drain wash water within the tub to the outside of the cabinet, wherein the drain passage connecting the tub and the drain pump is commonly used with part of the first detergent supply passage.

According to an example associated with an object of the present disclosure, the washing machine may further include a connecting pipe to connect the circulation pump and a water supply port of the automatic detergent supply unit to transfer wash water that has passed through the manual detergent supply unit to the water supply port of the automatic detergent supply unit.

According to an example associated with an object of the present disclosure, the automatic detergent supply unit may include a pumping device to selectively discharge detergent stored in a container by a predetermined amount.

According to an example associated with an object of the present disclosure, the pumping device may discharge detergent in the automatic detergent supply unit to at least one of the first and the second detergent supply passage.

According to an example associated with an object of the present disclosure, the automatic detergent supply unit may include a water supply port to flow wash water thereinto; an internal passage communicated with the water supply port to flow detergent discharged by the pumping device to be mixed with wash water; and a water drain port communicated with the internal passage to discharge the wash water mixed detergent.

According to an example associated with an object of the present disclosure, the automatic detergent supply unit may include a level sensing device to sense the remaining amount of detergent.

According to an example associated with an object of the present disclosure, the level sensing device may include a pair of electrodes an end portion of which is exposed to an inside of the container; a container-side connecting terminal connected to the electrode, and disposed on a bottom surface of the container; and a receiving-portion-side connecting terminal provided in the container receiving portion to be brought into contact with the container-side connecting terminal.

According to an example associated with an object of the present disclosure, the manual detergent supply unit may include a distribution plate provided at an upper portion of the dispenser case to distribute wash water; a detergent inlet portion provided with an input space to receive detergent and a water outlet port on a lower surface thereof, and disposed at a lower portion of the distribution plate to receive the wash water; a hopper portion provided at a lower portion of the detergent input portion to temporarily store wash water falling down through the water outlet port; and an extension portion extended downward from the hopper portion to discharge wash water or wash water mixed with detergent.

According to an example associated with an object of the present disclosure, the extension portion may include a backflow prevention device connected to the first detergent supply passage to prevent wash water discharged from the tub from flowing back to the detergent dispenser.

According to an example associated with an object of the present disclosure, the water outlet port may be formed at a lower rear portion of the detergent input portion, and a lower surface of the detergent input portion may be inclined downward as being close to the water output port, and disposed such that a portion formed with the water outlet port is higher than the remaining portion thereof when the detergent dispenser is rotated to an open position.

In order accomplish another object of the present disclosure, a washing machine according to the present disclosure may include a cabinet having an inlet port formed at a front panel for laundry insertion thereinto and a door to open or close the inlet port; a tub provided within the cabinet for storing wash water; a drum in communication with the inlet port, and rotatably provided within the tub; and a detergent dispenser provided below the inlet, wherein the detergent dispenser includes a dispenser case having an opening portion on an upper surface thereof; and at least one of an automatic detergent supply unit and a manual detergent supply unit mounted on the dispenser case, and the automatic detergent supply unit includes a container provided with an inlet port and an outlet port to store liquid detergent; a container receiving portion to receive the container; and a pumping device to selectively discharge liquid detergent discharged from the outlet port of the container according to a predetermined amount.

According to an example associated with another object of the present disclosure, the container receiving portion may include a mounting portion on an upper portion thereof to mount the container.

According to an example associated with another object of the present disclosure, the pumping device may be provided in the container receiving portion.

According to an example associated with another object of the present disclosure, the container receiving portion may include a water supply port to flow wash water thereinto; and a water drain port configured to flow the wash water or wash water mixed with detergent therefrom.

According to an example associated with another object of the present disclosure, the container receiving portion may include a boss portion to accommodate a discharge portion for discharging liquid detergent by the pumping device; and an internal passage to connect the water supply port and the water drain port, and communicated with the boss portion to flow the liquid detergent discharged from the discharge portion thereinto.

According to an example associated with another object of the present disclosure, a plurality of containers may be provided therein, and at least one container thereof may store detergent used during the washing, and another container may store detergent used during preliminary washing and rinsing.

According to an example associated with another object of the present disclosure, the container may include a grip portion on an upper portion thereof to allow a user to hold it with his or her hand.

According to an example associated with another object of the present disclosure, the container may be detachably coupled to an upper portion of the container receiving portion.

According to an example associated with another object of the present disclosure, the container receiving portion may further include a container support frame to form an insertion space of the container.

According to an example associated with another object of the present disclosure, the automatic detergent supply unit may include a drive unit to drive the pumping device; and a coupler to connect the drive unit and pumping device when the container is mounted on the mounting portion.

According to an example associated with another object of the present disclosure, the drive unit may include a motor housing provided in the container receiving portion; and a drive motor accommodated into the motor housing, and provided with a drive shaft protruded to an outside of the motor housing to be connected to the pumping device by the coupler.

According to an example associated with another object of the present disclosure, the automatic detergent supply unit may include a passage forming plate coupled to a bottom surface of the container to cover the outlet port, and the passage forming plate may include an inlet portion disposed to face the outlet port to flow the liquid detergent thereinto; a discharge portion to discharge liquid detergent by the pumping device; a supply passage to connect the inlet portion and the discharge portion to transfer liquid detergent flowed into the inlet portion to the discharge portion; and a receiving space formed on the supply passage to receive the pumping device.

According to an example associated with another object of the present disclosure, the pumping device may be provided with a gear pump to transmit liquid detergent flowed into the inlet portion to the discharge portion, and the gear pump may include a first and a second gear received into the receiving space, and rotatably supported by rotation shafts, respectively, and coupled to each other in an engaged manner.

According to an example associated with another object of the present disclosure, the coupler may include a driving gear disposed at an upper portion of the drive unit to be coupled to a drive shaft of the drive unit; and a driven gear disposed at a lower portion of the pumping device to be coupled to the driving gear in an engaged manner when the container is mounted on the mounting portion.

According to an example associated with another object of the present disclosure, either one of the rotation shafts of the gear pumps may be protruded through the passage forming plate, and the driven gear may be coupled to an end portion of the protruded rotation shaft.

According to an example associated with another object of the present disclosure, the automatic detergent supply unit may further include an agitator rotatably provided within the container.

According to an example associated with another object of the present disclosure, the other one of the rotation shafts of the gear pumps may be protruded into the container through the passage forming plate, and the agitator may be coupled to an end portion of the protruded rotation shaft.

In order to accomplish still another object of the present disclosure, a washing machine according to the present disclosure may include a cabinet having an inlet port formed at a front portion thereof for laundry insertion thereinto and a door to open or close the inlet port; a tub provided within the cabinet to store wash water therein; a drum communicated with the inlet port, and rotatably provided within the tub; and a detergent supply apparatus to receive wash water from a water source and supply the wash water and wash water mixed with detergent into the drum, wherein the detergent supply apparatus includes a detergent box comprising a liquid detergent storage unit having a storage space to store liquid detergent and a outlet port; and a pumping device provided in the liquid detergent storage unit to selectively discharge liquid detergent discharged from the outlet port according to a predetermined amount; and a dispenser housing provided in the cabinet to have an accommodation space to insert and withdraw the detergent box; and a water distribution unit provided on an upper surface of the dispenser housing to distribute wash water supplied from the water source to an inside of the detergent box.

According to an example associated with still another object of the present disclosure, the liquid detergent storage unit may include a drive unit provided in the dispenser housing to drive the pumping device; and a coupler to connect the drive unit and the pumping device when the detergent box is inserted and mounted within the dispenser housing.

According to an example associated with still another object of the present disclosure, the drive unit may include a motor housing provided at a rear side of the dispenser housing; and a drive motor accommodated into the motor housing, and provided with a drive shaft protruded to an outside of the motor housing to connect the pumping device by the coupler.

According to an example associated with still another object of the present disclosure, the liquid detergent storage unit may include a passage forming coupled to a rear surface of the detergent box to cover the outlet port, and the passage forming plate may include an inlet portion disposed to face the outlet port; a discharge portion to discharge liquid detergent transmitted by the pumping device; a supply passage to connect the inlet portion and the discharge portion to transfer liquid detergent flowed into the inlet portion to the discharge portion; and a receiving space formed on the supply passage to receive the pumping device.

According to an example associated with still another object of the present disclosure, the pumping device may be provided with a gear pump to transmit liquid detergent flowed into the inlet portion to the discharge portion, and the gear pump may include a first and a second gear received into the receiving space, and rotatably supported by rotation shafts, respectively, and coupled to each other in an engaged manner.

According to an example associated with still another object of the present disclosure, the coupler may include a driving gear disposed at a front side of the drive unit to be coupled to a drive shaft of the drive unit; and a driven gear disposed at a rear side of the pumping device to be coupled to the driving gear in an engaged manner when the detergent box is inserted and mounted on the dispenser housing.

According to an example associated with still another object of the present disclosure, either one of the rotation shafts of the gear pumps may be protruded through the passage forming plate, and the driven gear may be coupled to an end portion of the protruded rotation shaft.

According to an example associated with still another object of the present disclosure, the liquid detergent storage unit may include a cover plate provided with an inlet port for liquid detergent supplement; and an opening and closing plate rotatably mounted on the cover plate to open or close the inlet port.

According to an example associated with still another object of the present disclosure, the detergent box may include a wash water input portion separately partitioned from the liquid detergent storage unit to input wash water in the water distribution unit, and the dispenser housing may include a water passage provided at a rear lower portion thereof, and connected to the tub to supply wash water or wash water mixed with detergent to the tub; and a space portion to connect the wash water input portion, a discharge portion of the liquid detergent storage unit and the water passage to allow wash water flowed out of the wash water input portion and detergent discharged from the liquid detergent storage unit to be merged and mixed.

According to an example associated with still another object of the present disclosure, the detergent box may further include a powder detergent storage unit provided with a siphon tube therewithin to flow down wash water or wash water mixed with detergent, and separately partitioned from the liquid detergent storage unit; and a wash water drain path connected to the space portion to flow down wash water or wash water mixed with detergent that has passed through the siphon tube to the space unit.

According to an example associated with still another object of the present disclosure, a bottom surface of the liquid detergent storage unit may be formed in an inclined manner to be lowered toward the output port.

According to the present disclosure having the foregoing configuration, a user may bend his or her back to smaller extent since the height of the inlet port is increased, and an upper side of the tub is provided at a higher position, thereby easily inserting or withdrawing laundry.

Furthermore, an adequate amount of detergent may be automatically supplied to an inside of the tub to solve inconvenience in which a user should insert an adequate amount of detergent into the detergent input portion of the detergent supply apparatus, thereby having an effect of facilitating detergent supply.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

In the drawings.

DETAILED DESCRIPTION

Figure 1:
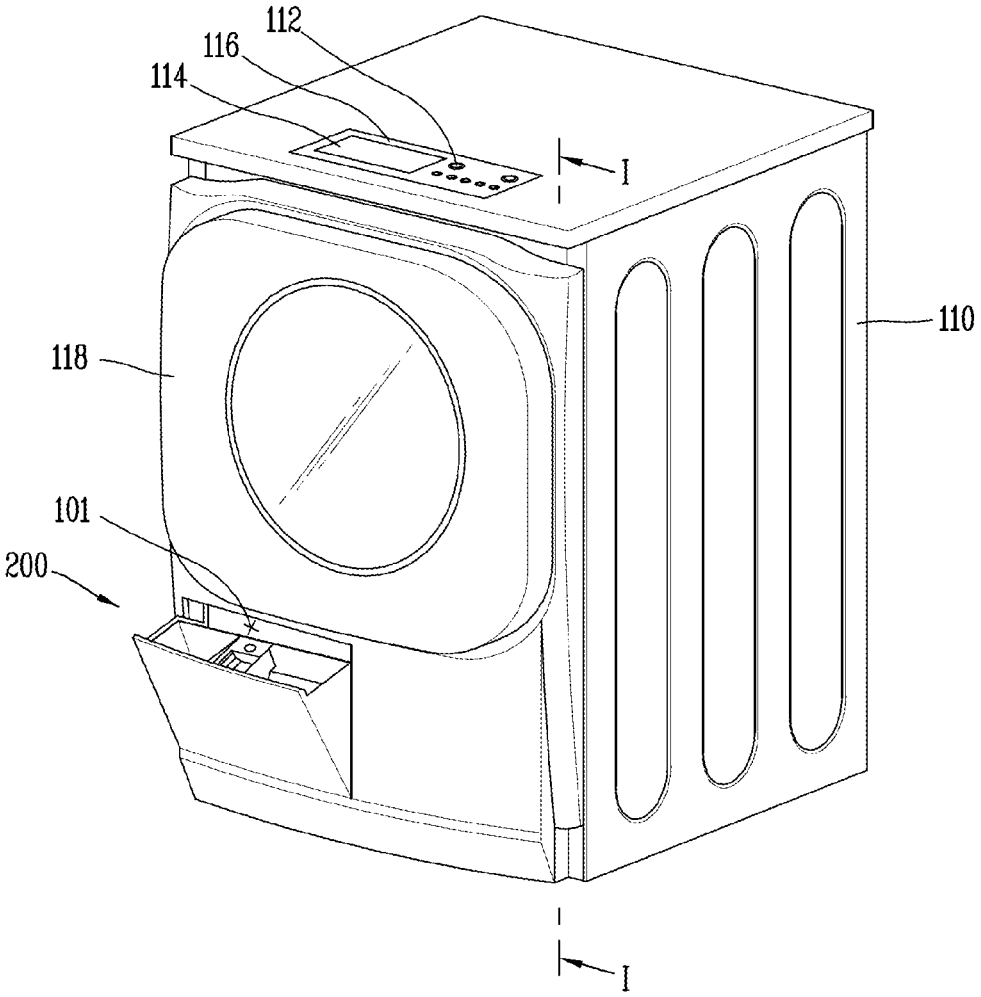
FIG. 1 is a perspective view illustrating a washing machine according to an embodiment of the present disclosure.

Hereinafter, the structure of a washing machine according to a preferred embodiment of the present invention will be described in detail with reference to the accompanying drawings. Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning.

Figure 2:
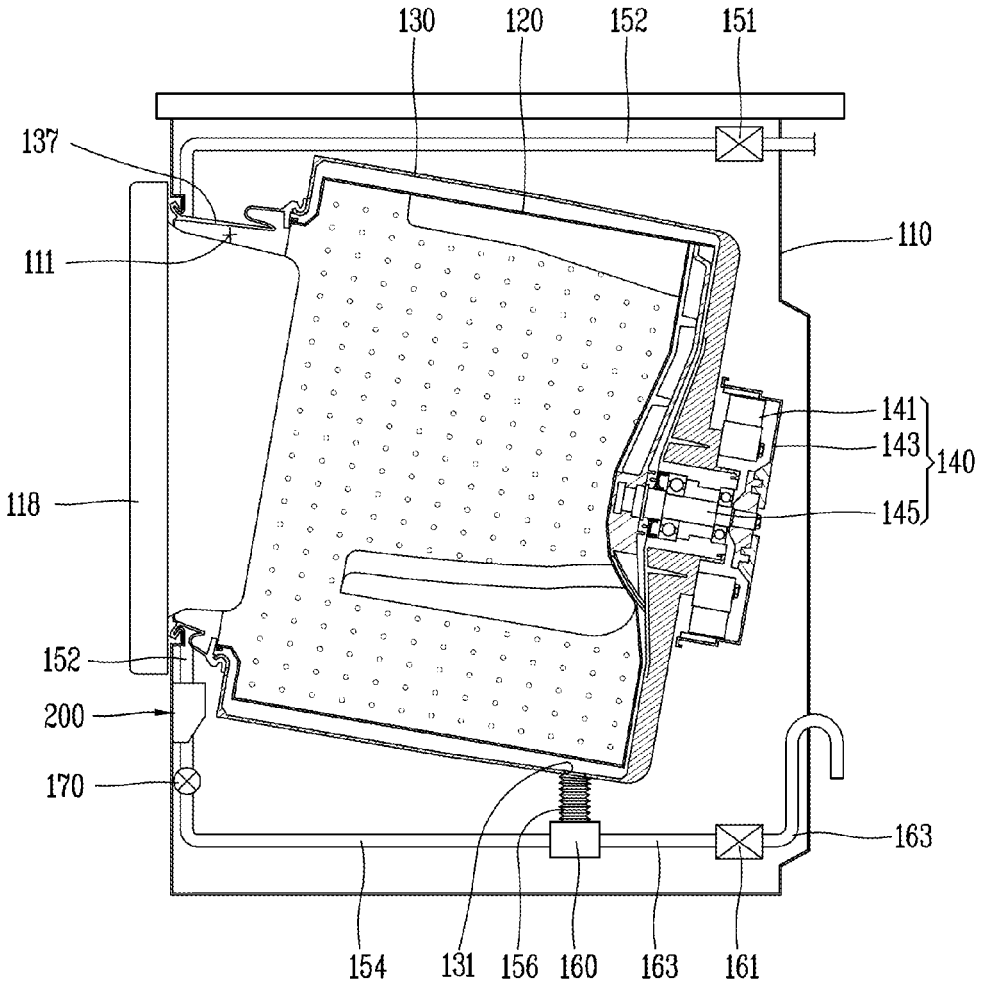
FIG. 2 is a cross-sectional view along a direction of I of FIG. 1.

FIG. 1 is a perspective view illustrating a washing machine according to an embodiment of the present disclosure, and FIG. 2 is a cross-sectional view along a direction of I of FIG. 1.

Referring to FIGS. 1 and 2, a washing machine according to an embodiment of the present disclosure may include a cabinet 110 forming an external appearance of the washing machine. Cabinet 110 has a substantially rectangular shape. A control panel 116 mounted with various manipulation devices 112 for manipulating a washing machine and a display device 114 for notifying the operational state of a washing machine to a user is provided on an upper surface of the cabinet 110. Of course, the configuration of control panel 116 may not be necessarily limited to this, and display device 114 may also be provided with a touch screen to receive a control command.

The controller is electrically connected to the control panel 116 and the components of the washing machine, respectively, to control the above components based on a control command entered through control panel 116 and a prestored program. Furthermore, the controller may transmit various information associated with the operation of the washing machine to control panel 116 to display them on display device 114.

An inlet port 111 which is a path for putting laundry into the drum 120 is formed on a front upper side of cabinet 110. Inlet port 111 communicates with an inside of drum 120. A user may put laundry into drum 120 or withdraw it from drum 120 through inlet port 111. A door 118 is rotatably coupled to a hinge on a front surface of cabinet 110 to open or close inlet port 111.

A detergent dispenser 200 is provided below inlet port 111. Inlet port 111 may be disposed to be biased in an upward direction from a front portion of cabinet 110. Due to this, as increasing the height of the inlet port compared to that of the inlet portion of the existing washing machine, a user may bend his or her back a little bit to insert or withdraw laundry, thereby facilitating the insertion and withdrawal of laundry.

An accommodation hole 101 for accommodating detergent dispenser 200 may be formed below inlet port 111 on a front surface of cabinet 110 to accommodate detergent dispenser 200.

A constituent element required to perform washing may be provided within cabinet 110. Referring to FIG. 2, a cylindrically-shaped tub 130 for storing wash water, and a drum 120 rotatably provided within tub 130 are provided in a receiving space formed within cabinet 110.

Tub 130 is formed in a substantially cylindrical shape, and a front surface of tub 130 is open to be connected to inlet port 111. Furthermore, a gasket 137 for sealing a front side of tub 130 and a periphery of the inlet port 111 are provided between a front surface portion of tub 130 and inlet port 111. Tub 130 is disposed to be inclined to a bottom surface of cabinet 110 such that the height of a front surface thereof is higher than that of a rear surface thereof.

When a front surface of tub 130 is disposed to be inclined at a higher position, a user may see up to a rear surface of drum 120 from inlet port 111 during the insertion of laundry and inlet port 111 may be formed towards the top of cabinet 110, thereby facilitating the insertion of laundry. Additionally, a front surface of tub 130 may be located higher than a rear surface thereof, and thus a sufficient space capable of installing detergent dispenser 200 below a front surface of the tub 130 may be provided.

A detergent inlet port 131 may be formed on a bottom surface of tub 130. Detergent inlet port 131 may be connected to communicate with a first detergent supply passage which will be described later. Furthermore, tub 130 may be supported by a spring (not shown) and a damper (not shown) installed within cabinet 110.

Drum 120 may be formed with a plurality of through holes to move wash water through drum 120 and flow wash water from tub 130 to drum 120. A plurality of lifts are provided to raise laundry on an inner surface of drum 120.

A drive unit 140 for driving drum 120 is provided at a rear portion of tub 130. Drive unit 140 includes a stator 141 and a rotor 143, and is connected to drum 120 by a rotation shaft 145 to transmit a rotational force to the drum 120. Rotation shaft 145 is supported by a bearing, and a sealing member for preventing wash water from being leaked from drum 120. The sealing member is provided at a connecting portion between rotation shaft 145 and drum 120.

Figure 3:
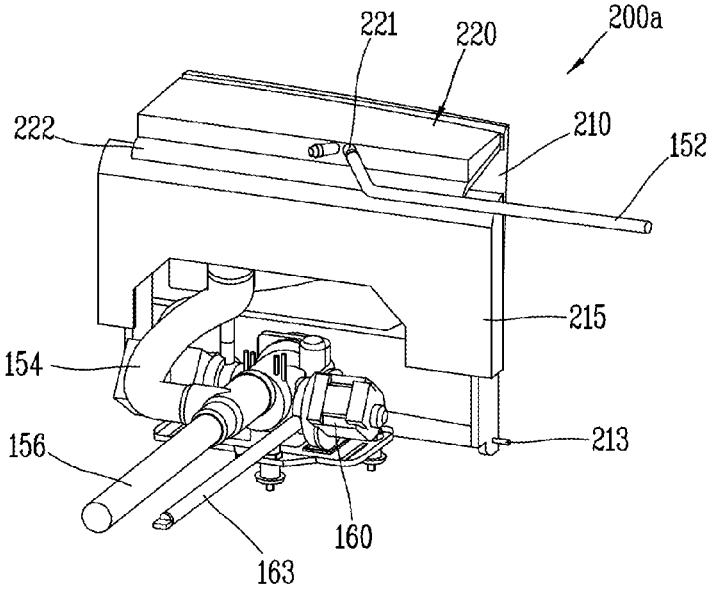
FIG. 3 is a rear perspective view illustrating a manual detergent supply unit according to the present disclosure.
Figure 4:
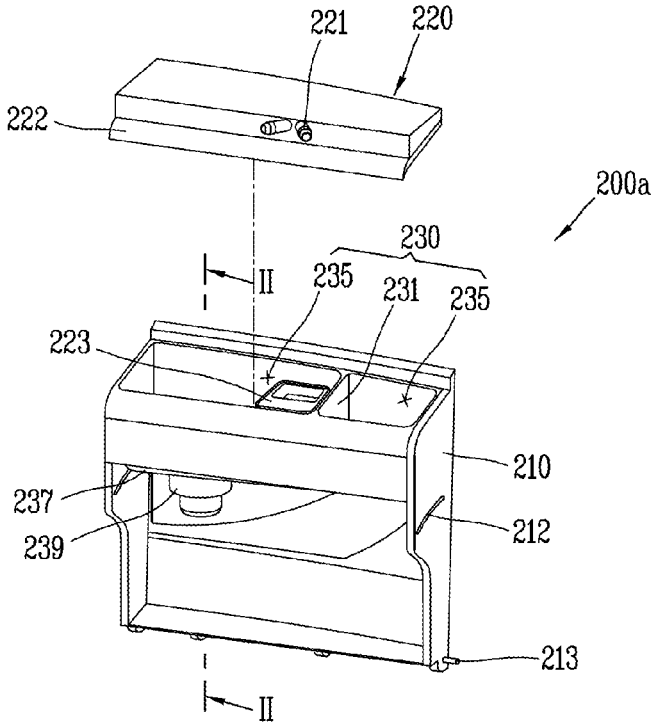
FIG. 4 is an exploded perspective view illustrating a state that a pump unit is removed in FIG. 3.
Figure 5:
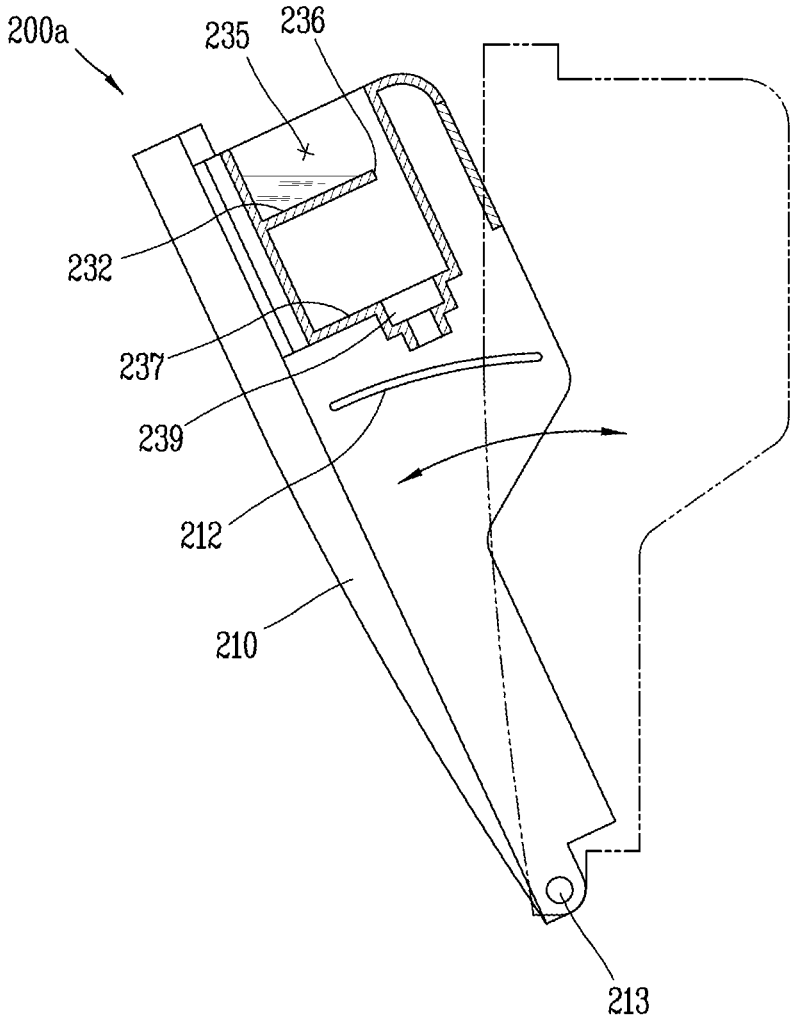
FIG. 5 is a side view illustrating a rotation operation state of a detergent dispenser in FIG. 3.

FIG. 3 is a rear perspective view illustrating a manual detergent supply unit 200*a* according to the present disclosure, and FIG. 4 is an exploded perspective view illustrating a state that a pump unit is removed in FIG. 3, and FIG. 5 is a side view illustrating a rotation operation state of a detergent dispenser 200 in FIG. 3.

Detergent dispenser 200 may include a dispenser case 210 and a detergent supply unit mounted on the dispenser case 210. The detergent supply unit may include at least one of a manual detergent supply unit 200*a* and an automatic detergent supply unit.

An embodiment illustrated in FIGS. 3 through 5 illustrates a state that the manual detergent supply unit 200*a* is mounted on the dispenser case 210. Manual detergent supply unit 200*a* may include a distribution plate 220, a detergent input portion 230 provided at a lower portion of the distribution plate 220 to put detergent thereinto, and a hopper portion 237 provided at a lower portion of the detergent input portion 230.

Detergent input portion 230 is open in an upward direction, and includes an input space 235 in which detergent is input and stored through an upper surface of the opening portion. Detergent input portion 230 may be partitioned into a plural number by a partition wall 231, and one of them may be used as a space for receiving the present detergent for washing, and the other one may be used as a space for receiving a preliminary detergent for washing. A rinsing detergent input portion 223 for receiving detergent for rinsing such as fabric softener may be separately provided in the present detergent input space for washing.

Input space 235 for receiving detergent may be formed with a different size.

There may be provided a plurality of input spaces 235, and a user may select an appropriate-sized input space 235 in proportion to an amount of laundry during detergent input or control the number of input spaces 235 for receiving detergent to intuitively control an amount of detergent.

Distribution plate 220 may include a wash water inlet portion 221 configured to receive wash water on a rear surface thereof, a distribution passage formed to communicate with the wash water inlet portion and formed to be divided into several branches to distribute the received wash water, a water supply hole formed on a bottom surface of the distribution passage to communicate with the detergent input portion 230. Wash water supplied from a water source flows into distribution plate 220 through wash water inlet portion 221, and is distributed to distribution passages within distribution plate 220, and thus the distributed wash water may be injected and supplied to the detergent input portion 230 through a water supply hole of the distribution passage Here, the user may put detergent into detergent input portion 230 of the manual detergent supply unit 200*a* while the detergent dispenser 200 is open, and wash water and detergent may be mixed with each other within the detergent input portion while detergent dispenser 200 is closed.

Detergent dispenser 200 may be formed to be withdrawn to a front surface of cabinet 110 while being rotated. To this end, dispenser case 210 is rotatably fastened to a front surface of cabinet 110.

Dispenser case 210 is accommodated in cabinet 110 through accommodation hole 101 for accommodating the detergent dispenser. Dispenser case 210 may include a front plate configured to form the whole or part of a lower panel located at a lower portion of the inlet port on a front panel of the cabinet, a lateral plate extended from both end portions of the front plate in a backward direction, and a hinge shaft 213 formed at a lower end portion of the lateral plate and coupled to the cabinet such that an upper end portion of the front plate is allowed to rotate in a forward or backward direction. Furthermore, a guide plate is formed at a rear side of the front plate to connect a rear end portion of the lateral plate and surround a container of the automatic detergent supply unit or the like, thereby guiding the insertion of a container or the like in the automatic detergent supply unit.

Hinge shaft 213 is rotatably fastened to a front lower end of cabinet 110. Hinge shaft 213 is extended in a lateral direction of cabinet 110 and coupled to cabinet 110, and dispenser case 210 is rotatable in a forward and backward direction of cabinet 110. Accordingly, detergent input portion 230 formed at an upper portion of dispenser case 210 is open while detergent dispenser 200 is rotated toward a front side of cabinet 110, and detergent input portion 230 is closed since the detergent input portion 230 is accommodated into the accommodation hole 101 while being rotated toward a rear side of cabinet 110.

Referring to FIG. 4, a guide groove 212 is further formed on a lateral surface of dispenser case 210 to guide and support the detergent dispenser 200 being rotated. A guide protrusion (not shown) is formed on a portion corresponding to guide groove 212 and is formed at a lateral surface of the accommodation hole 101 to be inserted into guide groove 212. Dispenser case 210 further includes a protective wall 215 configured to protect a constituent element, for example, detergent input portion 230 and a pipe of the first detergent supply passage 154 connected to detergent input portion 230 or the like, disposed at a rear surface when the detergent dispenser 200 is closed. Protective wall 215 is disposed to block a rear surface of the detergent dispenser 200, and thus when detergent dispenser 200 is closed, a rear surface of detergent dispenser 200 is placed on the protective wall 215.

Distribution plate 220 includes a cover 222 disposed at an upper portion of the detergent input portion 230 to cover the detergent input portion 230. Distribution plate 220 and cover 222 are fixed within cabinet 110, and thus separated from detergent input portion 230 when detergent dispenser 200 is open, and cover an upper surface of detergent input portion 230 by the cover 222 when detergent dispenser 200 is closed. Cover 222 is extended to an upper portion of the detergent input portion 230 from an upper edge of protective wall 215 to prevent wash water from being leaked out of the protective wall 215.

FIG. 5 is a side view illustrating a state where the detergent dispenser 200 in FIG. 1 is rotated. Referring to FIG. 5, detergent dispenser 200 is mounted such that the detergent input portion 230 formed at an upper portion of dispenser case 210 rotates between an open position at which cabinet 110 is exposed to the outside and an accommodation position at which the detergent input portion 230 is accommodated into cabinet 110. A state in which detergent dispenser 200 is withdrawn to an open position from accommodation hole 101 is illustrated with a solid line, and a state in which detergent dispenser 200 is accommodated in the accommodation hole 101 is illustrated with a dotted line.

Referring to FIG. 5, a water outlet port 236 is formed on a bottom surface 232 of the detergent input portion 230. The water outlet port 236 is formed to be biased to a rear side of cabinet 110 relative the bottom surface 232, and the bottom surface 232 is inclined to be lowered as being closed to the water outlet port 236, and thus a portion formed with the water outlet port 236 is higher than the bottom surface 232 when detergent dispenser 200 is withdrawn. Furthermore, bottom surface 232 is formed to be inclined downward as being close to the water output port 236 such that a portion formed with the water outlet port 236 is lower than the remaining portion thereof when detergent dispenser 200 is accommodated into cabinet 110. However, water outlet port 236 is formed to have an inclination to the extent that fluid flows to the water outlet port 236 by gravity even when it is not clearly inclined with naked eyes.

According to an aspect of the foregoing configuration, when detergent is put into detergent input portion 230 while detergent dispenser 200 is open water outlet port 236 is located higher than bottom surface 232 as illustrated in FIG.

5, and thus the inputted detergent does not flow out of water outlet port 236. Furthermore, while detergent dispenser 200 is accommodated in cabinet 110, bottom surface 232 is inclined toward water outlet port 236, and thus detergent along with wash water flows to the side of the water outlet port 236 by gravity.

Water outlet port 236 is formed to be extended along a boundary line between a rear surface of the detergent input portion 230 and bottom surface 232. Input space 235 communicates with hopper portion 237 by the water outlet port 236.

Hopper portion 237 is a space provided at a lower portion of the detergent input portion 230 to mix detergent and wash water falling down through water outlet port 236 and temporarily store them there. A bottom surface of hopper portion 237 is formed to be inclined toward an extension portion 239 to collect wash water into the extension portion 239.

Referring to FIG. 5, extension portion 239 is formed at a bottom surface of hopper portion 237, and formed to be biased to either one side thereof. In other words, when a rotational direction of detergent dispenser 200 is a width direction of the detergent dispenser 200, extension portion 239 is formed to be biased to a rear side with respect to the width direction. Furthermore, a bottom surface of hopper portion 237 is formed to be inclined downward to the side of the extension portion 239, and thus wash water flowed into the hopper portion 237 through the water outlet port 236 is guided to extension portion 239. Furthermore, extension portion 239 may be connected to a passage 154 for supplying wash water mixed with detergent to tub 130.

An inside of cabinet 110 may include at least one of a first water passage 153 configured to directly supply the wash water of the water source to tub 130 and a second water passage 152 configured to supply the wash water of the water source to detergent dispenser 200. A water valve 151 is provided on at least one of first water passage 153 and second water passage 152 to open or close first water passage 153 and/or second water passage 152. Water valve 151 may control an amount of wash water supplied to detergent dispenser 200 from the water source. According to an embodiment illustrated in FIG. 2, second water passage 152 configured to supply the wash water of the water source to detergent dispenser 200 is illustrated.

An inside of cabinet 110 may include a connecting passage for supplying the detergent of detergent dispenser 200 to tub 130. The connecting passage may include a first detergent supply passage 154, 156 for supplying the detergent of detergent dispenser 200 to a bottom surface of the tub and a second detergent supply passage for supplying the detergent of detergent dispenser 200 to the remaining part of tub 130 excluding the bottom surface of tub 130.

An inside of cabinet 110 may include a water passage 163 for discharging wash water stored in tub 130 to an outside of cabinet 110.

According to a passage having the foregoing configuration, the wash water of the water source may be directly supplied to tub 130 through the first water passage or supplied to detergent dispenser 200 through the second water passage 152. According to the second water passage 152 illustrated in FIG. 2, the wash water of the water source may be supplied to detergent dispenser 200.

The detergent of detergent dispenser 200 may be supplied to a bottom surface of tub 130 through the first detergent supply passage 154, 156 or supplied to the remaining part excluding the bottom surface of the tub, for example, an upper portion of tub 130 or an upper portion of gasket 137 through the second detergent supply passage. According to detergent supply passage 154, 156 illustrated in FIG. 2, detergent is supplied to a bottom surface of tub 130 through the first detergent supply passage 154, 156.

The first detergent supply passage 154, 156 may connect a bottom surface of tub 130 to detergent dispenser 200 so as to transfer wash water stored in tub 130 to detergent dispenser 200 or transfer the detergent of detergent dispenser 200 to the bottom surface of tub 130. The first detergent supply passage 154, 156 may be configured with two passages 154, 156 to supply the detergent of detergent dispenser 200 to the bottom surface of tub 130 through drain pump 160. For example, one 154 of the two first detergent supply passage 154, 156 may connect detergent dispenser 200 and drain pump 160. The other one 156 of the first detergent supply passage 154, 156 may connect drain pump 160 and tub 130. Due to this the detergent of detergent dispenser 200 may be supplied to the bottom surface of tub 130 through drain pump 160. The first detergent supply passage 156 connecting between drain pump 160 and tub 130 may be formed with a bellows type pipe.

Detergent such as laundry detergent, fabric softener, bleach, or the like may be accommodated into detergent dispenser 200, and the wash water of the water source passes through detergent dispenser 200 through the second water passage 152 to mix detergent with wash water.

Wash water discharged from extension portion 239 illustrated in FIG. 5 is supplied to drain pump 160 through the first detergent supply passage 154 illustrated in FIG. 3 and then supplied to detergent inlet port 131 formed at a bottom surface of tub 130 through the first detergent supply passage 156 connecting drain pump 160 and tub 130. Here, detergent inlet port 131 may be separately formed from the water drain port of tub 130 or used for both the water drain port or detergent inlet port of tub 130.

Furthermore, drain pump 160 is also connected to water passage 163 extended to an outside of cabinet 110. A valve 161 is provided in water passage 163 to selectively supply wash water discharged from drain pump 160 to the first detergent supply passage 156 or the water passage 163. In other words, when wash water discharged from drain pump 160 is desired to be supplied to the first detergent supply passage 156, the controller closes valve 161. Furthermore, when wash water discharged from drain pump 160 is desired to be supplied to the water passage 163, the controller opens valve 161.

Here, when valve 161 is closed, wash water that has passed through detergent dispenser 200 or wash water mixed with detergent may be flowed into tub 130 through detergent inlet port 131 formed at a bottom surface of tub 130 via drain pump 160 and first detergent supply passage 156 from the water source by water pressure.

Furthermore, when valve 161 is open, wash water or wash water mixed with detergent may be drained to an outside of cabinet 110 through water passage 163 by the pumping power of drain pump 160.

Accordingly, wash water or wash water mixed with detergent that has passed through detergent dispenser 200 is supplied to a bottom surface of the tub via the first detergent supply passage 156 and drain pump 160 provided at a lower portion of tub 130 or wash water stored in tub 130 is drained, thereby having a simple configuration. Furthermore, detergent may be well dissolved in wash water while passing through drain pump 160, thereby obtaining an effect of supplying detergent in a state that most of detergent is dissolved in wash water when supplying detergent to tub 130.

Referring to FIG. 2, first detergent supply passage 154 may further include a backflow prevention device 170 to prevent wash water or wash water mixed with detergent discharged from the tub from flowing back to the detergent dispenser. A check valve or the like may be used for the backflow prevention device 170. However, the installation position of the backflow prevention device 170 may not be necessarily limited to this, and may be also installed in the extension portion 239 or installed in the hopper portion 237.

In cases where the backflow prevention device 170 is installed in the extension portion 239 or the hopper portion 237, when wash water fills up above a predetermined height in the extension portion 239 or the hopper portion 237 other than the check valve, it may be configured that a buoy blocks the extension portion 239 while being floated.

Figure 6:
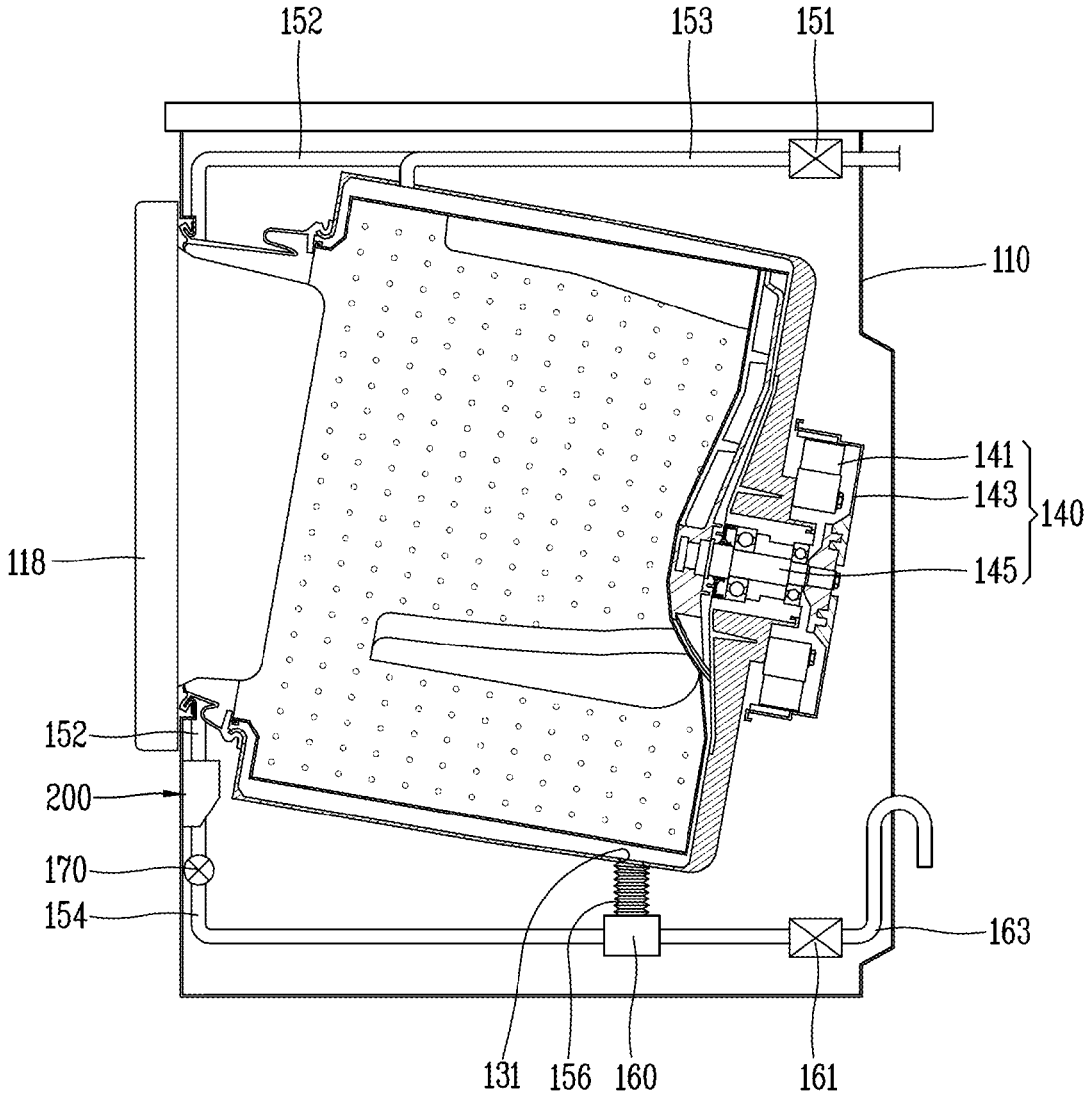
FIG. 6 is a cross-sectional view illustrating a washing machine according to another embodiment of the present disclosure.

FIG. 6 is a cross-sectional view illustrating a washing machine according to another embodiment of the present disclosure. An embodiment illustrated in FIG. 6 may include a first water passage 153 for directly supplying wash water to tub 130 and a second water passage 152 for supplying wash water to detergent dispenser 200. The other constituent elements are the same or similar to the foregoing constituent elements according to an embodiment of the present disclosure, and thus the detailed description thereof will be omitted for clarity of explanation.

First water passage 153 directly supplies the wash water of the water source to tub 130 without passing through detergent dispenser 200. Here, the first water passage 153 supplies wash water to tub 130 at a position higher than that of the backflow prevention device 170. First water passage 153 may be connected to an upper surface of tub 130 or connected to gasket 137 to supply wash water to an inside of tub 130.

According to an aspect of the foregoing configuration, wash water may be supplied to a lower portion of tub 130 through drain pump 160 and supplied to an upper portion of tub 130 through the first water passage 153, rather than being supplied to the first detergent supply passage 154, 156 and drain pump 160, thereby having an effect of efficiently supplying a large amount of wash water.

Here, the controller may control drain pump 160, valve 161, water valve 151, and the like to supply wash water up to a height of the backflow prevention device 170 through the first detergent supply passage 156 and then supply wash water through first water passage 153. However, the backflow prevention device 170 may not be necessarily limited to the installation position illustrated in FIG. 6, and may be also installed to be higher than or at the same height as that of the bottom surface of tub 130.

According to an aspect of the foregoing configuration, wash water mixed with detergent may be supplied to a bottom surface of tub 130 through drain pump 160 up to a height installed with the backflow prevention device 170, and wash water is supplied through the first water passage 153 when wash water fills up to a height of the backflow prevention device 170 on the bottom surface of tub 130, thereby supplying wash water to tub 130 without difficulty even if the pumping power of the drain pump 160 is more or less small.

Figure 7:
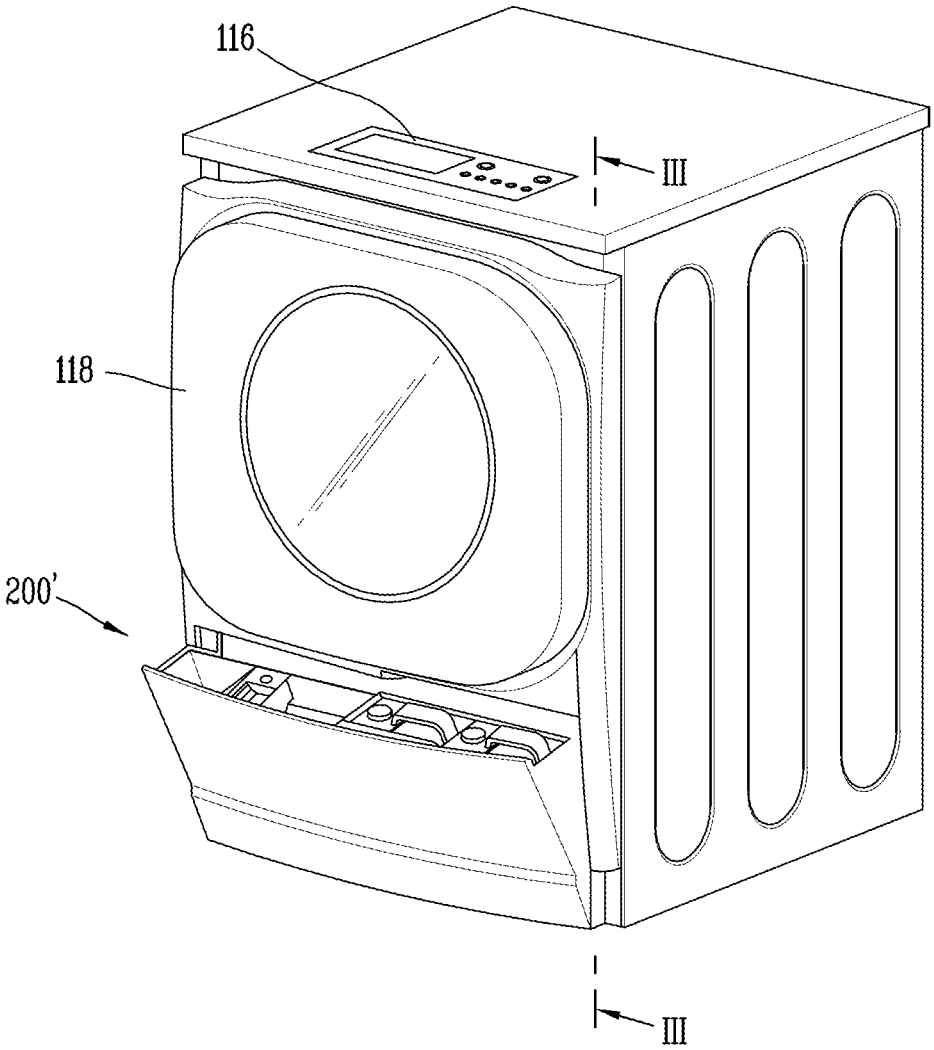
FIG. 7 is a perspective view illustrating a washing machine according to still another embodiment of the present disclosure.
Figure 8:
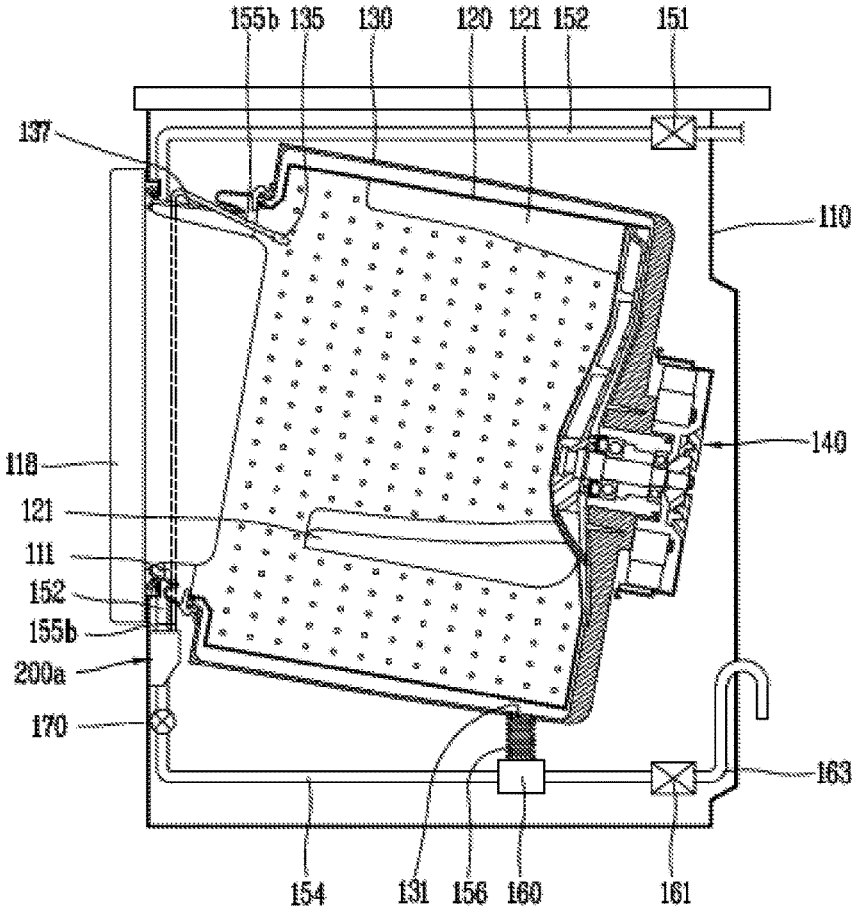
FIG. 8 is a cross-sectional view along a direction of III of FIG. 7.
Figure 9:
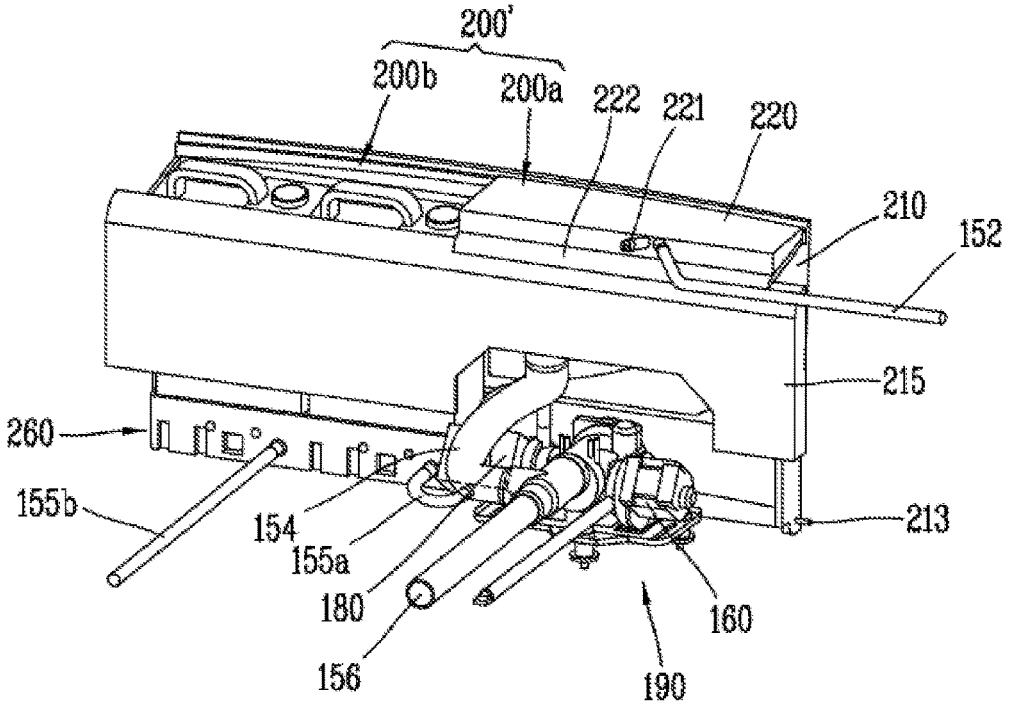
FIG. 9 is a rear perspective view illustrating a state that a manual detergent supply unit and an automatic detergent supply unit according to the present disclosure are mounted on a dispenser case.
Figure 10:
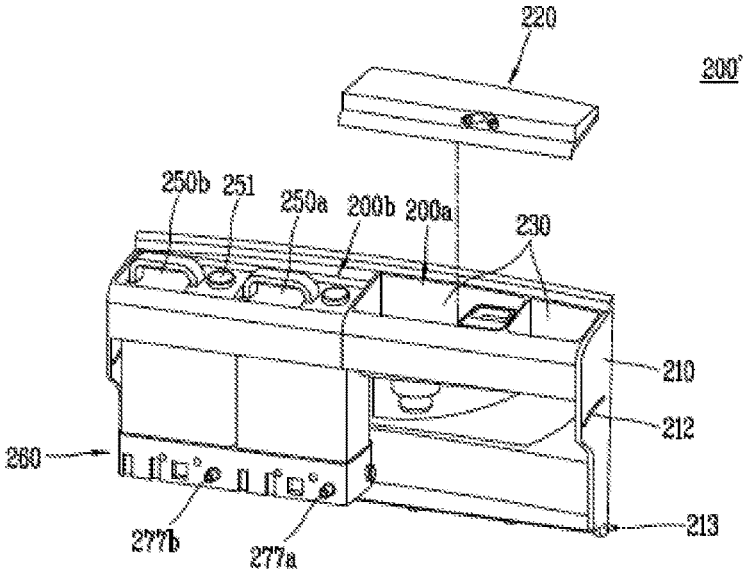
FIG. 10 is an exploded perspective view illustrating a state that a distribution plate of the manual detergent supply unit is taken apart from a manual detergent supply unit in FIG. 9.
Figure 11:
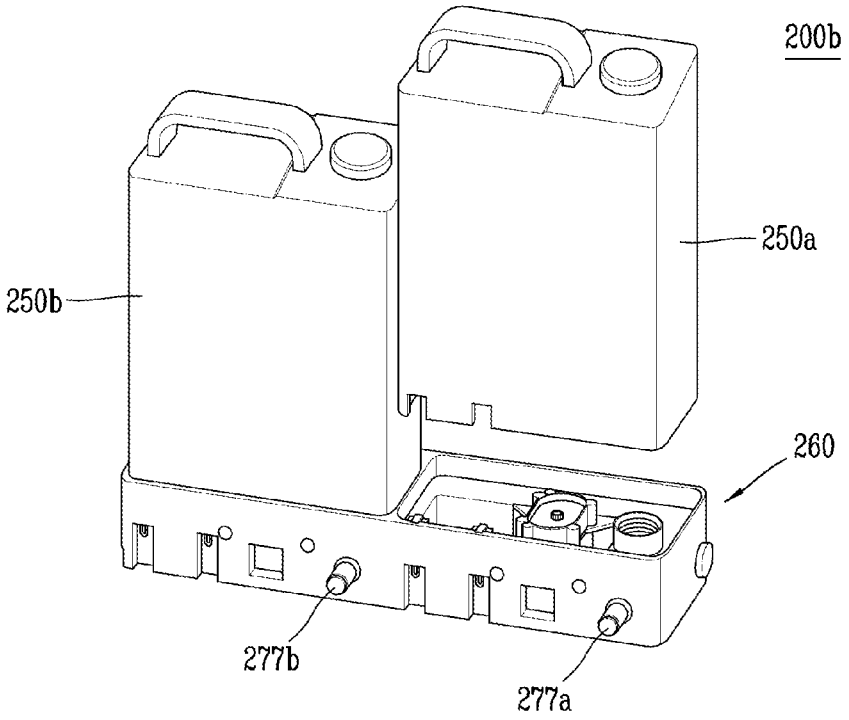
FIG. 11 is a perspective view illustrating a state that containers are mounted on a container receiving portion in an automatic detergent supply unit according to the present disclosure.
Figure 12:
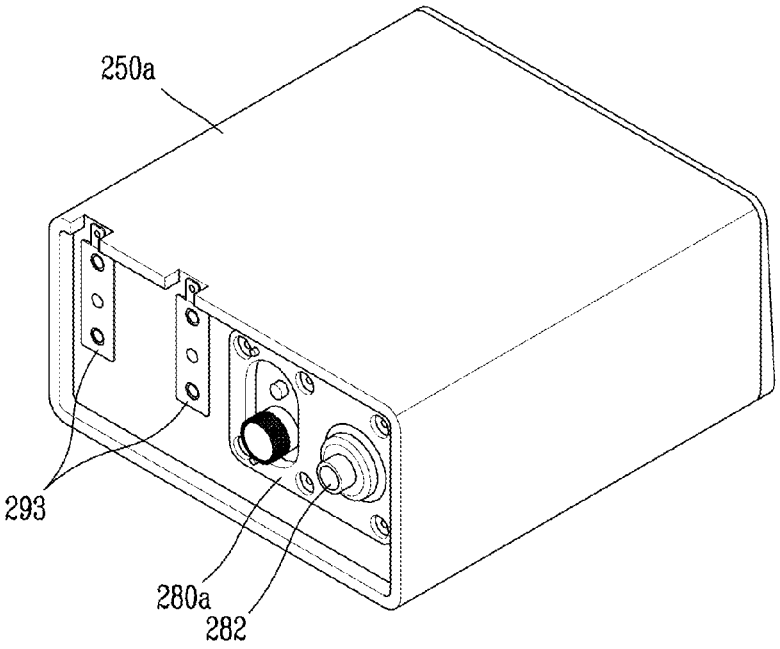
FIG. 12 is a bottom perspective view illustrating a container illustrated in FIG. 11.
Figure 13:
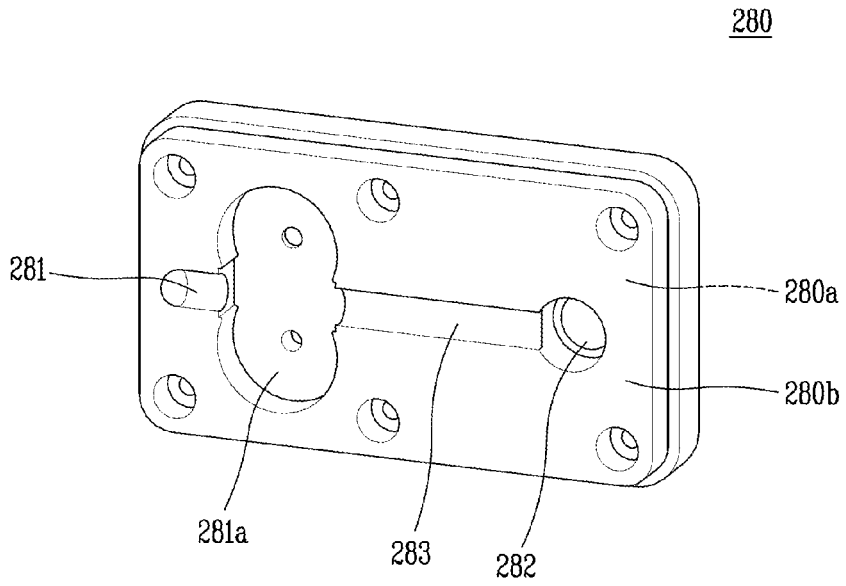
FIG. 13 is a perspective view illustrating an upper surface of a passage forming plate mounted on a bottom surface of the container in FIG. 12.
Figure 14:
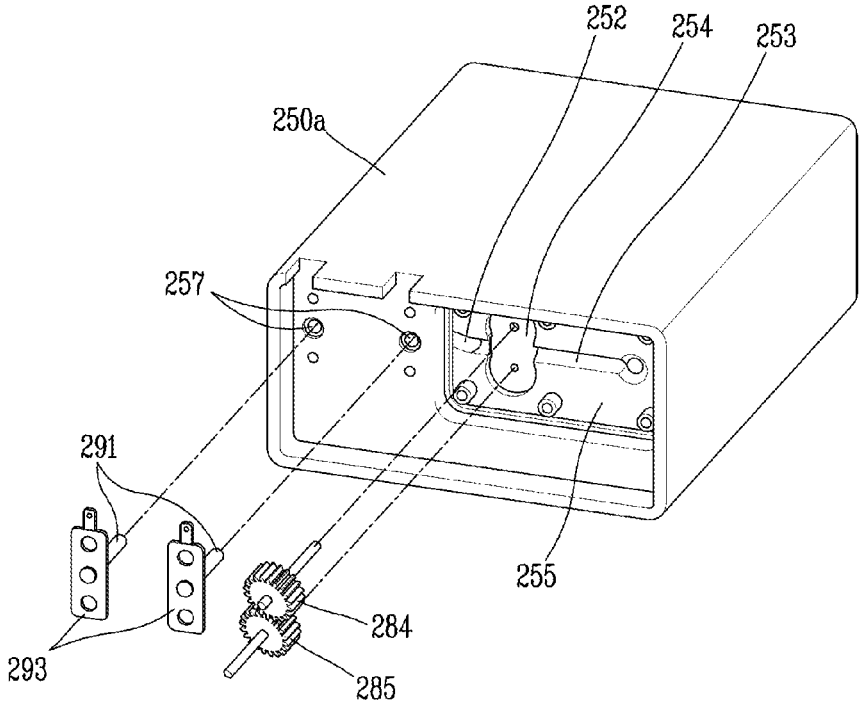
FIG. 14 is an exploded perspective view illustrating a gear pump and a detergent sensor mounted on a bottom surface of the container.
Figure 15:
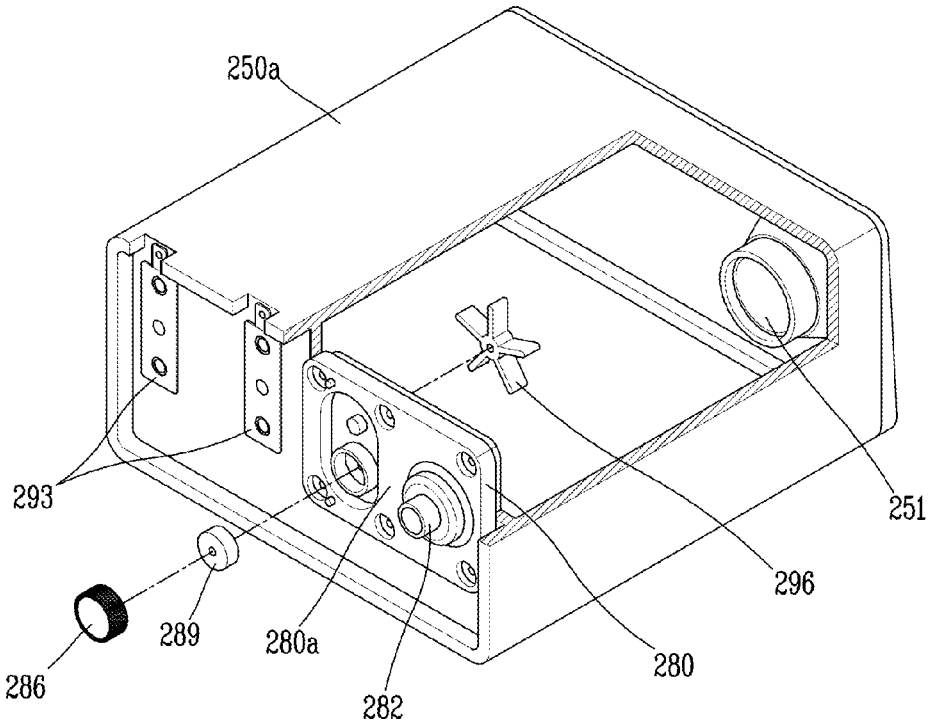
FIG. 15 is a partially-cut perspective view of FIG. 12.
Figure 16:
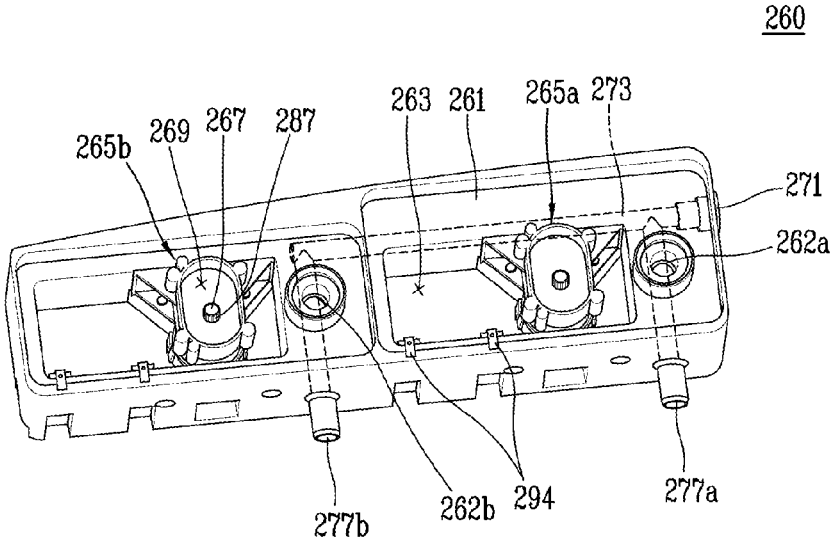
FIG. 16 is a perspective view illustrating an internal configuration of a container receiving portion illustrated in FIG. 11.

FIG. 7 is a perspective view illustrating a washing machine according to still another embodiment of the present disclosure, and FIG. 8 is a cross-sectional view along a direction of III of FIG. 7. FIG. 9 is a rear perspective view illustrating a state that a manual detergent supply unit 200*a* and an automatic detergent supply unit 200*b* according to the present disclosure are mounted on a dispenser case 210, and FIG. 10 is an exploded perspective view illustrating a state that a distribution plate 220 is taken apart from a manual detergent supply unit 200*a* in FIG. 9. FIG. 11 is a perspective view illustrating a state where containers 250*a*, 250*b* are mounted on a container receiving portion 260 in an automatic detergent supply unit 200*b* according to the present disclosure, and FIG. 12 is a bottom perspective view illustrating a container 250*a*, 250*b* illustrated in FIG. 11. FIG. 13 is a perspective view illustrating an upper surface of a passage forming plate 280 mounted on a bottom surface of the container 250*a*, 250*b* in FIG. 12. FIG. 14 is an exploded perspective view illustrating a gear pump and a detergent sensor mounted on a bottom surface of the container 250*a*, 250*b*, and FIG. 15 is a partially-cut perspective view of FIG. 12, and FIG. 16 is a perspective view illustrating an internal configuration of a container receiving portion 260 illustrated in FIG. 11.

Figure 25:
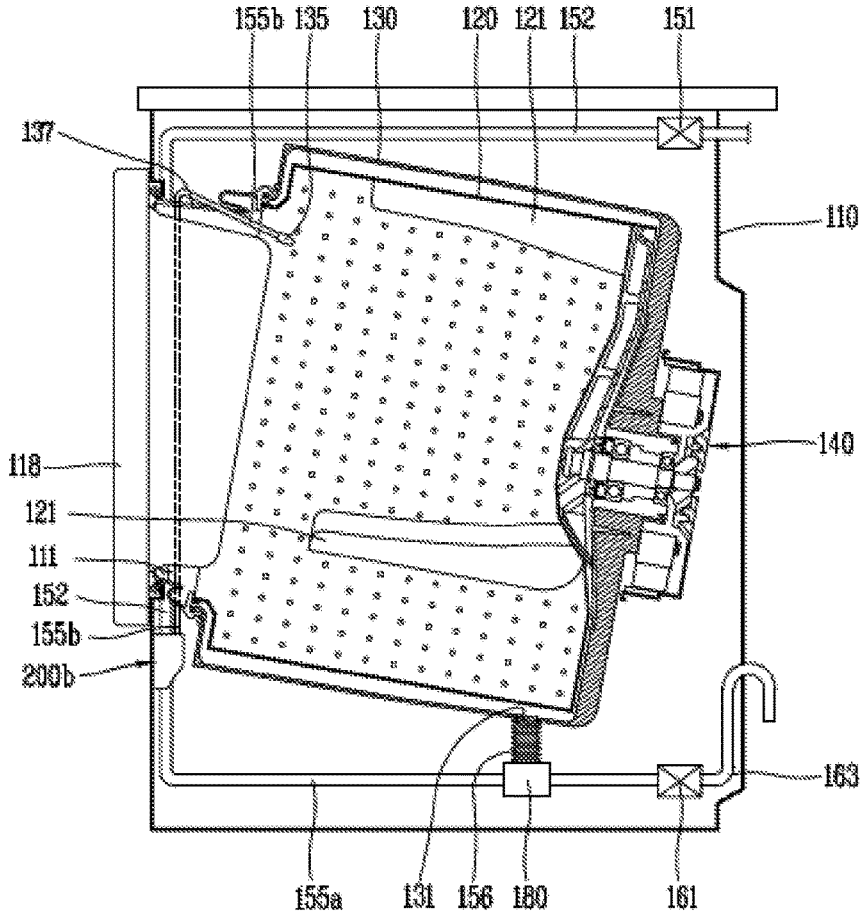
FIG. 25 is a cross-sectional view illustrating a connecting pipe connecting an automatic detergent supply unit in FIG. 9 to a circulation pump.

A detergent dispenser 200' according to the present disclosure may include at least one of an automatic detergent supply unit 200*b* and a manual detergent supply unit 200*a*. For example, detergent dispenser 200' may include the automatic detergent supply unit 200*b* or include the manual detergent supply unit 200*a* or include both the detergent supply units 200*a*, 200*b*. The first supply passage 154 having the backflow prevention device 170 shown in FIG. 8 is connected with the manual detergent supply unit 200*a*. A connecting pipe 155*a* shown in FIGS. 9 and 25 connects the circulation pump 180 with the automatic detergent supply unit 200*b*, and the wash water discharged from the tub 120 is supplied to the automatic detergent supply unit 200*b* through the first detergent supply passage 156 and the connecting pipe 155*a*.

Automatic detergent supply unit 200*b* will be described with reference to FIGS. 11 through 16.

Automatic detergent supply unit 200*b* may include a plurality of containers 250*a*, 250*b* configured to store detergent, a pumping device configured to selectively discharge liquid detergent discharged through an outlet port 252 of the containers 250*a*, 250*b* according to a predetermined amount, and a container receiving portion 260 having a mounting portion 261 on which the container 250*a*, 250*b* are mounted.

The two containers 250*a*, 250*b* may be formed with different capacities or shapes. Furthermore, the containers 250*a*, 250*b* may be configured in such a manner that fluids for treating different types of laundries are stored in the containers 250*a*, 250*b*, respectively, and selectively supplied to wash water according to their necessity. Of course, only one of the containers 250*a*, 250*b* may be provided therein.

For example, the detergent for washing used during the present washing may be stored in at least one container 250*a* of the two containers 250*a*, 250*b*, and preliminary detergent for washing used during preliminary washing or fabric softener used during rinsing may be stored in another container 250*b*.

A grip portion may be provided on an upper portion of the containers 250*a*, 250*b* to allow a user to hold the container 250*a*, 250*b* with his or her hand, and thus has an advantage of facilitating the delivery of the container 250*a*, 250*b* as well as the insertion and removal of dispenser case 210.

A lower portion of the container 250*a*, 250*b* may be detachably coupled to container receiving portion 260. Furthermore, a container support frame may be further provided in container receiving portion 260 to limit a space in which the container 250*a*, 250*b* is inserted into the container receiving portion 260 and guide the insertion of the container 250*a*, 250*b*. The container support frame may have the same shape as that of a peripheral surface of container receiving portion 260.

The basic configuration of the container 250*a*, 250*b* is the same, and hereinafter, it will be described based on the container 250*a* illustrated in the right side of the drawing.

Referring to FIG. 15, a storage space configured to store detergent therein is formed within container 250*a*, and an inlet port 251 capable of supplying detergent to the storage space from the outside is formed at an upper portion of the container 250*a*. Referring to FIG. 14, an outlet port 252 is formed on a bottom surface of the container 250*a*.

Automatic detergent supply unit 200*b* may include a passage forming plate 280 coupled to a bottom surface of the container 250*a* to cover outlet port 252.

A mounting portion 255 to which passage forming plate 280 is placed thereon to be fastened is formed on a bottom surface of container 250*a*. Outlet port 252 is formed at one side of mounting portion 255.

Referring to FIG. 13, passage forming plate 280 may include an inlet port 281 formed on a surface 280*b* (hereinafter, an upper surface of the passage forming plate) facing the outlet port 252, a discharge portion 282 configured to discharge liquid detergent pumped by a pumping device, a supply passage configured to connect inlet port 281 and discharge portion 282 to move liquid detergent flowed into inlet port 281 to discharge portion 282, a receiving space 254, 281*a* formed on the supply passage to accommodate the pumping device.

Furthermore, the pumping device may be provided with a gear pump configured to transmit liquid detergent flowed into inlet port 281 of the passage forming plate 280 to discharge portion 282.

Inlet port 281 is formed in a groove shape on an upper surface 280*b* of the passage forming plate 280 and communicated with the receiving space to guide detergent discharged from outlet port 252 to an inside of the gear pump in the receiving space.

The supply passage may include a first passage forming groove 253 formed on mounting portion 255 to connect outlet port 252 and discharge portion 282, and a second passage forming groove 283 formed on an upper surface of the passage forming plate 280 to connect inlet port 281 and discharge portion 282.

Receiving space 254, 281*a* into which the gear pump is accommodated may include a first receiving space 254 formed between the outlet port 252 and the first passage forming groove 253 and a second receiving space 281*a* formed between the inlet port 281 and the second passage forming groove 283.

The gear pump may include a first gear 284 and a second gear 285 engaged with each other, and the first and the second gear 284, 285 are accommodated between the first and the second receiving space 254, 281*a*. The rotation shaft of first gear 284 and second gear 285 is rotatably coupled to the first and the second receiving space 254, 281*a*. The rotation shaft of first gear 284 is extended to be protruded into container 250*a* through the first receiving space 254 to transmit power to an agitator 296 which will be described later.

Furthermore, the rotation shaft of second gear 285 is extended out of a bottom surface 280*a* of the passage forming plate 280 through the second receiving space 281*a* and connected to a driven gear 286 of the coupler to receive power from the driven gear 286 of the coupler.

Accordingly, a predetermined amount of detergent may be selectively discharged through discharge portion 282 by the pumping device. Furthermore, when detergent is more or less agglomerated, detergent is ground while passing between the first and the second gear 284, 285, thereby being easily dissolved in wash water.

Referring to FIGS. 14 and 15, a sealing member 289 for preventing detergent flowing through the supply passage 253, 283 from being leaked to the rotation shaft of the second gear 285 is further formed on the rotation shaft of the second gear 285. Sealing member 289 may be provided between driven gear 286 of the coupler and the bottom surface 280*a* of the passage forming plate 280. The coupler will be described later.

Container receiving portion 260 may include a mounting portion 261 on which the container 250*a*, 250*b* are mounted and a drive unit 265*a*, 265*b* configured to drive the pumping device. A bottom surface of the container 250*a*, 250*b* is placed on mounting portion 261 and the pumping device is connected to the drive unit 265*a*, 265*b* by the coupler. To this end, mounting portion 261 is formed in a groove shape having the same area as that of a lower silhouette of the container 250*a*, 250*b*.

A drive unit receiving portion 263 and a boss portion 262*a*, 262*b* are formed on mounting portion 261. The drive unit 265*a*, 265*b* is accommodated and installed in the drive unit receiving portion 263. Here, the drive unit 265*a*, 265*b* is installed at a position corresponding to the foregoing gear pump.

Furthermore, the boss portion 262*a*, 262*b* is installed at a position corresponding to discharge portion 282, and when the container 250*a*, 250*b* is mounted on mounting portion 261, discharge portion 282 is inserted into the boss portion 262*a*, 262*b* and supported by the boss portion 262*a*, 262*b*.

Two drive units 265*a*, 265*b* are provided to correspond to the number of containers 250*a*, 250*b*, and hereinafter it will be described based on the left drive unit 265*b*. The drive unit 265*b* may include a motor housing fixed to the drive unit receiving portion 263 and a driving motor accommodated into the motor housing. A coupler receiving portion 269 into which the coupler is accommodated is formed in a groove shape on an upper surface of the motor housing, and a drive shaft 267 of the driving motor is protruded on an upper surface of the coupler receiving portion 269.

The coupler may include a driving gear 287 and a driven gear 286 to connect the pumping device and the drive unit 265*a*, 265*b*. Specifically, drive shaft 267 is inserted into a shaft insertion hole formed at a central portion of the driving gear 287, and driving gear 287 is coupled to drive shaft 267 to be rotated together therewith. Accordingly, when drive shaft 267 is rotated, driving gear 287 coupled to the drive shaft 267 is rotated together therewith.

Driven gear 286 is connected to the rotation shaft of the second gear 285 on a bottom surface of the passage forming plate 280. Furthermore, driven gear 286 is received in the coupler receiving portion 269 to be engaged with driving gear 287 when the container 250*b* is mounted on mounting portion 261. Accordingly, when driving gear 287 is rotated, driven gear 286 is rotated in engagement therewith, and the second gear 285 connected to driven gear 286 on the same rotation shaft is rotated. Accordingly, a predetermined amount of detergent is discharged to discharge portion 282 while the gear pump which is a pumping device is rotated.

Detergent discharged from discharge portion 282 is mixed with wash water within container receiving portion 260. Container receiving portion 260 may include a water supply port 277*a* configured to flow wash water thereinto, a water drain port 277*b* configured to flow wash water or wash water mixed with detergent therefrom, a boss portion 262*b* configured to receive the discharge portion 282 to support a peripheral surface of the discharge portion 282, and an internal passage 273 configured to flow wash water therein and connect the water supply port 277*a* and the water drain port 277*b*.

Internal passage 273 is formed to pass through a lower portion of boss portion 262*b* and communicate with a lower portion of discharge portion 282 inserted into boss portion 262*b*, and thus wash water and detergent are mixed as detergent discharged from discharge portion 282 flows thereinto. Here, wash water mixed with detergent may be supplied to an inside of tub 130 from the internal passage 273.

Automatic detergent supply unit 200*b* and tub 130 may be connected to each other by a connecting passage. The connecting passage connects detergent dispenser 200' and tub 130 to transfer wash water stored in tub 130 to the automatic detergent supply unit 200*b* or transfer detergent stored in the automatic detergent supply unit 200*b* to tub 130.

The connecting passage may include a first detergent supply passage configured to connect detergent dispenser 200' and a bottom surface of tub 130 to supply detergent from detergent dispenser 200' to the bottom surface of tub 130, and a second detergent supply passage 155*b* configured to connect detergent dispenser 200' and the remaining part of tub 130 to supply detergent from the detergent dispenser to the remaining part of tub 130 excluding the bottom surface of tub 130.

Detergent inlet port 131 is formed on a bottom surface of tub 130, and the detergent of the first detergent supply passage 154, 156 may flow into detergent inlet port 131. The remaining part of tub 130 may be part of gasket 137 connecting inlet port 111 to a front portion of tub 130, for example. One end portion of the second detergent supply passage 155*b* is connected to water drain port 277*b* of the automatic detergent supply unit 200*b*, and a nozzle 135 may be installed at the other end of the second detergent supply passage 155*b*. Nozzle 135 may be coupled to an upper portion of gasket 137 in a fixed manner.

The detergent of automatic detergent supply unit 200*b* having the foregoing configuration may be supplied to tub 130 through at least one of the first detergent supply passage and the second detergent supply passage 155*b*.

For example, the detergent of the automatic detergent supply unit 200*b* may be supplied to a bottom surface of tub 130 through the first detergent supply passage. The first detergent supply passage may connect water drain port 277*b* of the automatic detergent supply unit 200*b* to the detergent inlet port 131 of tub 130 to flow wash water stored in tub 130 to the boss portion 262*a*, 262*b* through the first detergent supply passage via the water supply port of the automatic detergent supply unit 200*b* and internal passage 273, and the detergent of the automatic detergent supply unit 200*b* may be discharged from discharge portion 282 to boss portion 262*a*, 262*b* according to a predetermined amount to be mixed with wash water, and wash water mixed with detergent may be supplied to a bottom surface of tub 130.

Otherwise, the detergent of the automatic detergent supply unit 200*b* may be supplied to tub 130 and drum 120 through the remaining part of tub 130, for example, the nozzle 135 installed in gasket 137 provided at a front portion of tub 130, through the second detergent supply passage 155*b*.

Otherwise, the detergent of the automatic detergent supply unit 200*b* may be supplied to a bottom surface of tub 130 and the remaining part thereof through the first detergent supply passage and the second detergent supply passage 155*b*.

The detergent of the automatic detergent supply unit 200*b* may be discharged from discharge portion 282 to boss portion 262*a*, 262*b* according to a predetermined amount to be mixed with wash water, and wash water mixed with detergent may move along the second detergent supply passage 155*b* connecting water drain port 277*b* of the automatic detergent supply unit 200*b* and gasket 137 of tub 130 to be sprayed from nozzle 135 of the second detergent supply passage 155*b* fixed to an upper portion of the gasket 137 of tub 130 to an inside of tub 130 and drum 120. Here, the circulation pump 180 is installed within cabinet 110, and a partial passage of the circulation pump 180 is connected to the internal passage 273 of the automatic detergent supply unit 200*b*, and thus detergent may be transferred along the second detergent supply passage 155*b* by the pumping power of circulation pump 180.

A container support frame (not shown) configured to guide the insertion and withdrawal of the container 250*a*, 250*b* may be separately installed within cabinet 110 from dispenser case 210.

An embodiment illustrated in FIGS. 7 through 10 may include a modified embodiment of the foregoing detergent dispenser 200', and thus the description of the same reference numerals will be omitted below.

For the detergent dispenser 200' illustrated in FIG. 7, dispenser case 210 may include the automatic detergent supply unit 200*b* along with the manual detergent supply unit 200*a*.

At least one detergent of the automatic detergent supply unit 200*b* and manual detergent supply unit 200*a* may be supplied to a bottom surface of tub 130 through the first detergent supply passage 154, 156. Otherwise, at least one detergent of the automatic detergent supply unit 200*b* and manual detergent supply unit 200*a* may be supplied to the remaining part of tub 130, for example, an upper portion of gasket 137 installed at a front side of tub 130, through the second detergent supply passage 155*b*. Otherwise, At least one detergent of the automatic detergent supply unit 200*b* and manual detergent supply unit 200*a* may be supplied to a bottom surface of tub 130 and the remaining part thereof through the first detergent supply passage 154, 156 and the second detergent supply passage 155*b*, respectively.

Detergent dispenser 200' may receive wash water from a water source through the second water passage 152 or receive wash water from tub 130 through the first detergent supply passage 154, 156. Furthermore, detergent dispenser 200' may supply detergent to the received wash water, wash water mixed with detergent in detergent dispenser 200' may be supplied to an inside of tub 130 through at least one of the first detergent supply passage 154, 156 and the second detergent supply passage 155*b*.

For example, the bottom surface of tub 130 may be located higher than the container receiving portion 260 of the automatic detergent supply unit 200*b*, and thus wash water discharged from tub 130 through the first detergent supply passage 154, 156 may be supplied to the internal passage 273 of the automatic detergent supply unit 200*b* via circulation pump 180 by gravity and potential energy.

Additionally, the manual detergent supply unit 200*a* may be located below inlet port 111, and the wash water of the water source may be supplied to the distribution plate 220 of the manual detergent supply unit 200*a* through the second water passage 152 by water pressure.

Referring to FIG. 8, wash water supplied from the water source is supplied to manual detergent supply unit 200*a* of detergent dispenser 200', and the detergent and wash water of the manual detergent supply unit 200*a* are mixed, and then supplied to a bottom surface of tub 130 through the first detergent supply passage 154, 156. Furthermore, wash water that has passed through the manual detergent supply unit 200*a* is supplied to the automatic detergent supply unit 200*b* through circulation pump 180, and the detergent and wash water of the automatic detergent supply unit 200*b* are mixed and then supplied to an upper portion of tub 130, for example, through the second detergent supply passage 155*b*.

However, the detergent supply unit may be configured with only the automatic detergent supply unit 200*b* or manual detergent supply unit 200*a*. When configured with only the automatic detergent supply unit 200*b*, the automatic detergent supply unit 200*b* may put detergent into wash water received from the tub 130 through the first detergent supply passage 154, 156 to supply it to a bottom surface of the tub 130 or supply it to the remaining part of tub 130 through the second detergent supply passage 155*b*.

Here, the second water passage 152 may be connected to the water supply port 277*a* of the automatic detergent supply unit 200*b* to supply the wash water of the water source to the automatic detergent supply unit 200*b* or the first detergent supply passage 154, 156 may be connected to the water supply port 277*a* of the automatic detergent supply unit 200*b* to supply wash water stored in tub 130 to the internal passage 273 of the automatic detergent supply unit 200*b*.

Otherwise, when configured with only the manual detergent supply unit 200*a*, the manual detergent supply unit 200*a* may supply wash water mixed with detergent to a bottom surface of the tub 130 through the first detergent supply passage 154, 156 or supply it to the remaining part of tub 130 through second detergent supply passage 155*b*. Here, the second water passage 152 is connected to distribution plate 220 of the manual detergent supply unit 200*a* to supply the wash water of the water source to the manual detergent supply unit 200*a*.

Detergent dispenser 200' illustrated in FIG. 9 may include the manual detergent supply unit 200*a* and automatic detergent supply unit 200*b*, and a pump module 190 may be disposed at a lower portion of dispenser case 210. Pump module 190 may include a circulation pump 180 configured to circulate wash water or wash water mixed with detergent that has passed through detergent dispenser 200' to tub 130, and a drain pump 160 configured to discharge wash water or wash water mixed with detergent that has passed through detergent dispenser 200 to an outside of cabinet 110.

First detergent supply passage 154 may connect manual detergent supply unit 200*a*, pump module 190, and tub 130, thereby allowing wash water or wash water mixed with detergent discharged from the manual detergent supply unit 200*a* to be supplied to pump module 190 and tub 130.

A branch tube having a 3-way passage connecting portion is disposed at a downstream side of pump module 190. One passage connecting portion of the branch tube is connected to the first detergent supply passage 154, and another passage connecting portion of the branch tube is connected to the pump module 190, and still another passage connecting portion of the branch tube is connected to detergent inlet port 131 of tub 130.

Wash water or wash water mixed with detergent that has passed through the manual detergent supply unit 200*a* flows into the branch tube through the first detergent supply passage 154, and flows from the branch tube to the circulation pump 180 of pump module 190. Furthermore, a connecting pipe 155*a* is provided at one side of circulation pump 180, and the connecting pipe 155*a* connects circulation pump 180 to the automatic detergent supply unit 200*b*.

Due to a passage configured as described above, wash water flows from circulation pump 180 to water supply port 277*a* of the automatic detergent supply unit 200*b* through connecting pipe 155*a* by the pumping power of circulation pump 180, and wash water that has flowed into the water supply port 277*a* moves along the internal passage 273 of the automatic detergent supply unit 200*b* and flows into the boss portion 262*a*, 262*b* to be mixed with detergent that has flowed into the boss portion 262*a*, 262*b* and then flows to the second detergent supply passage 155*b* through water drain port 277*b*. Detergent flowed out of the automatic detergent supply unit moves along the second detergent supply passage 155*b* to be supplied to an inside of tub 130 and drum 120 through nozzle 135 fixed to an upper portion of the gasket of tub 130.

Here, the internal passage 273 may be formed in a zigzag shape to well mix detergent.

Referring to FIG. 15, an agitator 296 may be rotatably installed on a bottom surface of the inside of the container 250*a*. Agitator 296 may be connected to rotation shaft 145 of first gear 284 to transfer detergent in the container 250*a* to the side of the outlet port 252 while rotating along with first gear 284 during the rotation of first gear 284. To this end, the end of the vanes formed on agitator 296 is formed to be extended to the side of the outlet port 252.

According to an aspect of the foregoing configuration, it has an effect of easily moving detergent to the outlet port 252. Furthermore, according to an aspect of the foregoing configuration, a lower layer of detergent stored in the container 250*a* may be agitated, thereby obtaining an effect of preventing detergent from being settled down to create a layer.

According to another embodiment of the present disclosure, a level sensing device for checking the remaining amount of stored detergent may be further provided on a bottom surface of the container 250*a* illustrated in FIG. 14. The level sensing device may include a pair of electrodes 291 exposed to detergent, a container-side connecting terminal 293 connected to the pair of electrodes 291 and disposed on a bottom surface of the container 250*a*, and a receiving-portion-side connecting terminal 294 provided in the container receiving portion 260 to be brought into contact with the container-side connecting terminal 293.

The pair of electrodes 291 are inserted into insertion holes 257, respectively, formed to pass through a bottom surface of the container 250*a*, and exposed to an inside of the container 250*a*. The container-side connecting terminal 293 is fixed to a bottom surface of container 250*a*, and an end thereof is protruded to an inside of the container 250*a*. Furthermore, the receiving-portion-side connecting terminal 294 is installed on an inner surface of the drive unit receiving portion 263 at a position corresponding to the container-side connecting terminal 293 and an end thereof is extended to an upper surface of the mounting portion 261. Accordingly, when the storage unit is placed on mounting portion 261, the container-side connecting terminal 293 disposed on a bottom surface of the container 250*a* is brought into contact with the receiving-portion-side connecting terminal 294. The receiving-portion-side connecting terminal 294 is electrically connected to the controller, and when a current does not flow through the pair of electrodes 291, the controller may display the need for detergent supply through display device 114.

Hereinafter, a washing machine 300 provided with an automatic detergent supply unit 310 according to still another embodiment of the present disclosure will be described with reference to FIG. 17.

Figure 17:
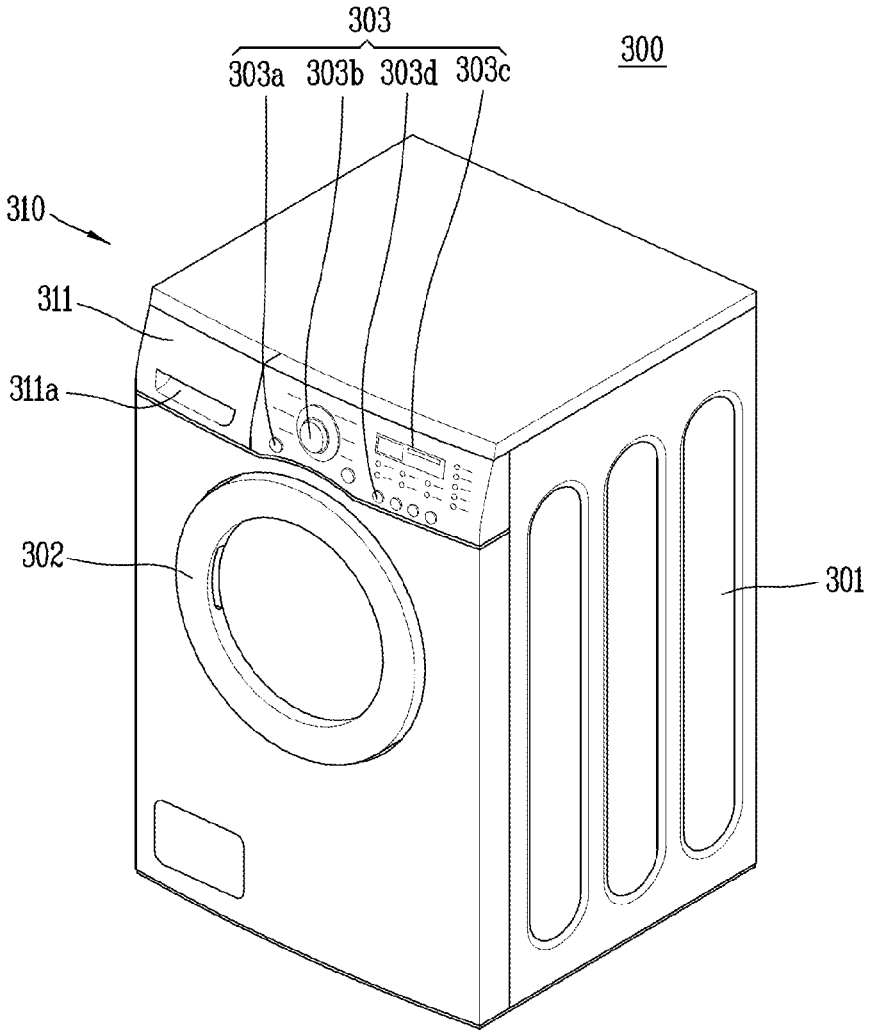
FIG. 17 is a perspective view illustrating a washing machine according to still another embodiment of the present disclosure.

FIG. 17 enclosed herewith is a perspective view illustrating a washing machine 300 according to still another embodiment of the present disclosure. Washing machine 300 may include a cabinet 301, a tub, a drum, a lift, and a drum drive motor.

Cabinet 301 may form an external appearance of the washing machine 300.

A laundry inlet port may be provided on a front surface of cabinet 301 to put laundry into the drum therethrough.

Furthermore, a door 302 is coupled to a front surface of cabinet 301 in a hinge structure, and door 302 is open to put laundry thereinto through the laundry inlet port during the insertion of laundry or collection of laundry which has completed the washing process. Door 302 is closed during the washing cycle.

The tub is horizontally installed in a cylindrical shape within the cabinet 301, and a wash water storage space is provided therein to receive wash water from a water source.

The drum is rotatably installed within the tub to wash laundry inserted thereinto.

The drum has a plurality of drain holes along a lateral surface thereof, and thus wash water stored in the tub through the drain holes or wash water containing detergent may flow into the drum or water within the drum may flow out to an inner side of the tub.

The lift is disposed to be spaced apart on an inner surface of the drum in a circumferential direction, and installed to be fixed therewith along a length of an axial direction, and the lift is interlocked with the drum, and laundry falls down from a predetermined height prior to reaching the apex while rotating in a state that laundry is placed on the lift, thereby efficiently performing the washing cycle.

The drum drive motor is mounted at a rear side of the tub to generate a rotational force to rotate the drum. A decelerator is installed on an output shaft of the drum drive motor to control the rotational speed of the drum.

Hereinafter, a detergent supply apparatus 310 according to still another embodiment of the present disclosure will be described in detail with reference to FIGS. 18 through 22.

Figure 18:
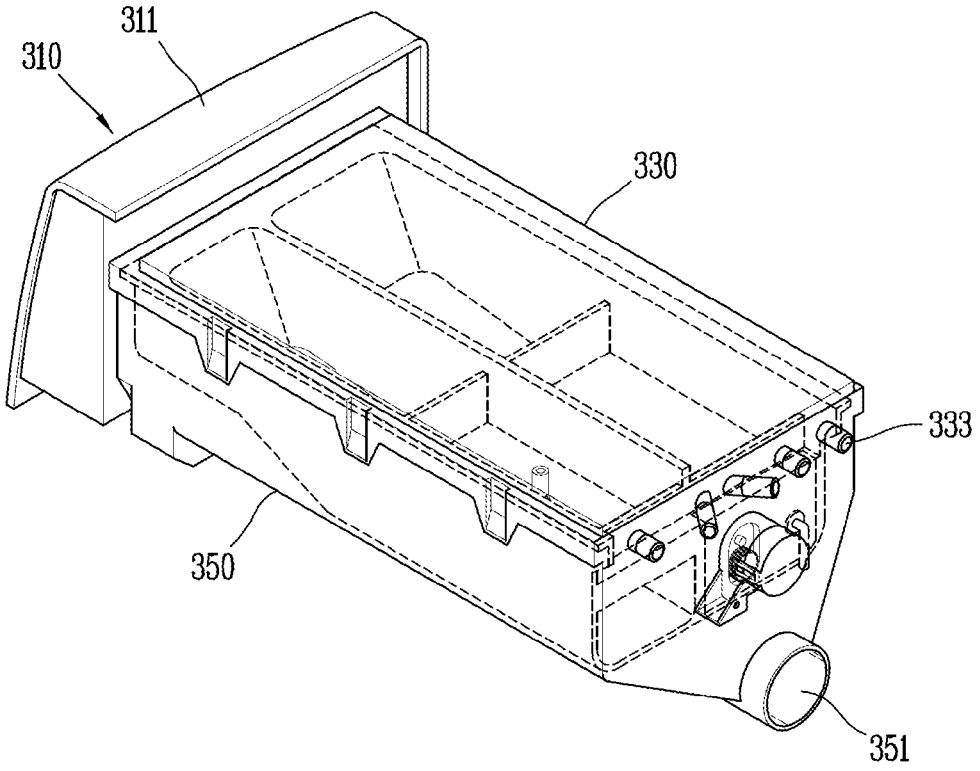
FIG. 18 is a perspective view illustrating an automatic detergent supply apparatus according to still another embodiment of the present disclosure.
Figure 19:
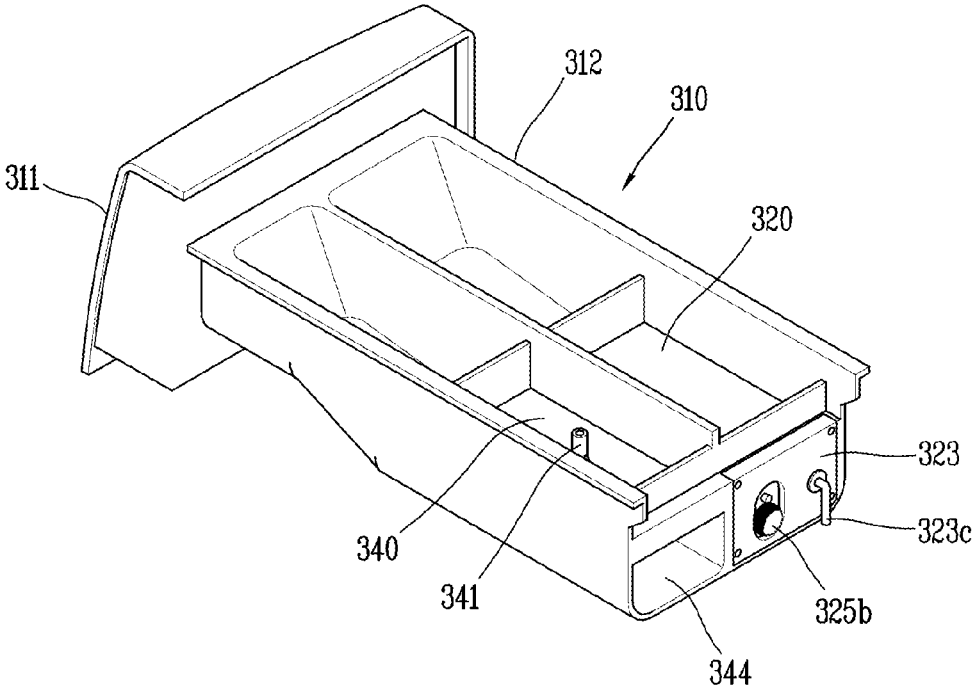
FIG. 19 is a perspective view illustrating an internal structure of a detergent box in FIG. 18.
Figure 20:
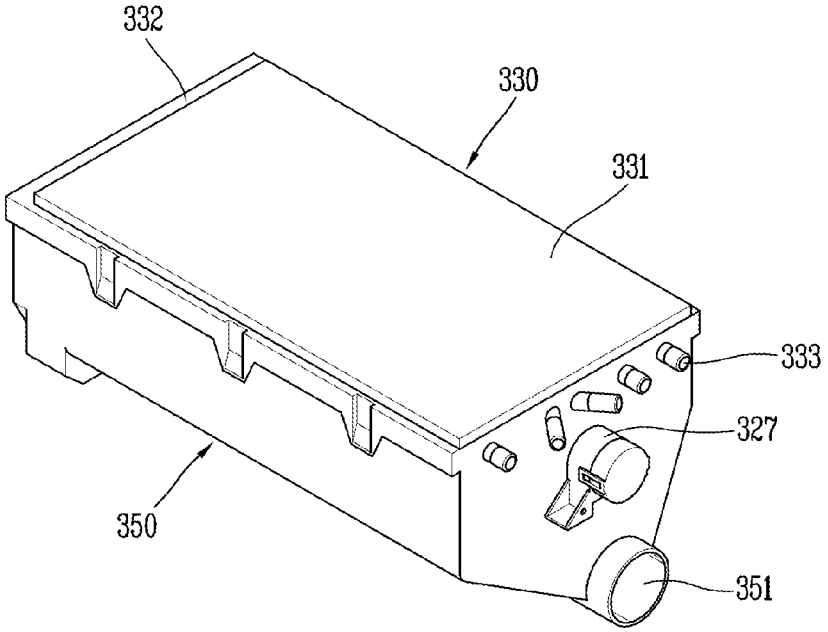
FIG. 20 is a perspective view illustrating an external appearance of a dispenser housing in FIG. 19.

FIG. 18 enclosed herewith is a perspective view illustrating an automatic detergent supply apparatus 310 according to still another embodiment of the present disclosure, and FIG. 19 is a perspective view illustrating an internal structure of a detergent box 312 in FIG. 18, and FIG. 20 is a perspective view illustrating an external appearance of a dispenser housing 350 in FIG. 19.

Figure 21:
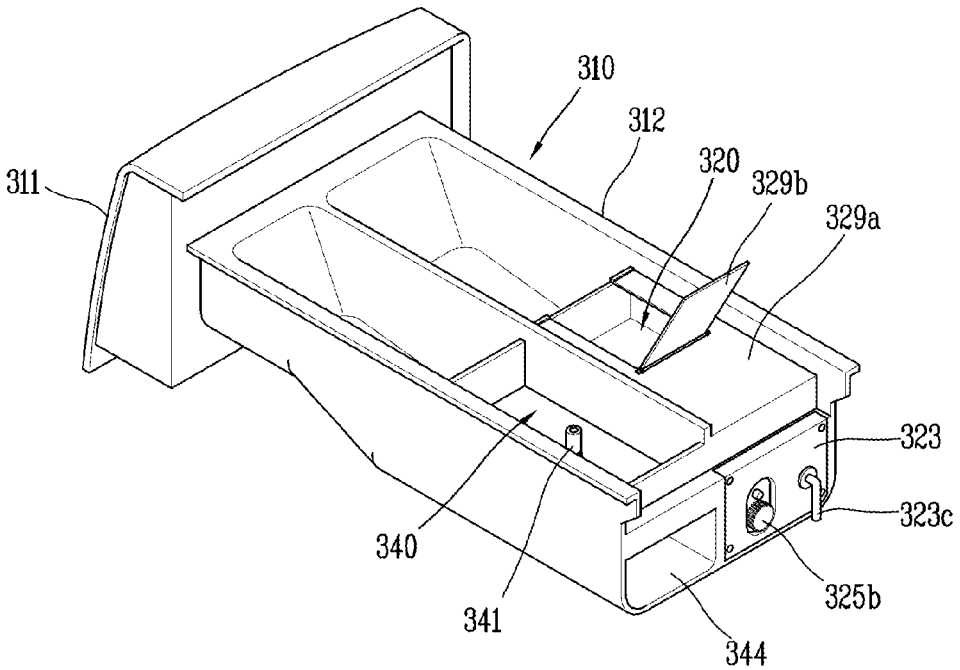
FIG. 21 is a perspective view illustrating a state that an opening and closing plate is open on a liquid detergent storage unit in FIG. 19.
Figure 22:
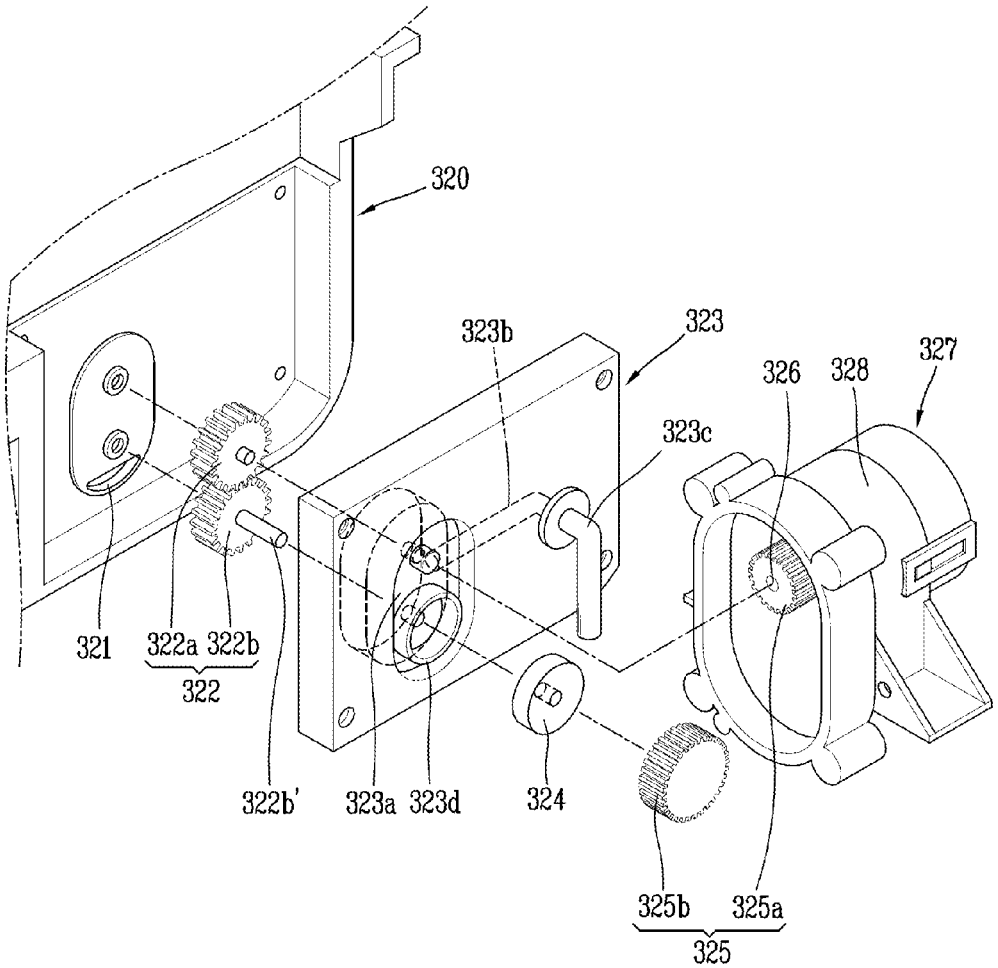
FIG. 22 is an exploded perspective view illustrating a pumping device and a drive unit provided in a liquid detergent storage unit in FIG. 20.

Moreover, FIG. 21 is a perspective view illustrating a state that an opening and closing plate 329*b* is open on a liquid detergent storage unit 320 in FIG. 19, and FIG. 22 is an exploded perspective view illustrating a pumping device 322 and a drive unit 327 provided in a liquid detergent storage unit 320 in FIG. 20.

Washing machine 300 according to the present disclosure provides a detergent supply apparatus 310 into which detergent can be inserted.

A water pipe is installed at a lower portion of the upper plate of cabinet 301.

An end portion of the water pipe is connected to a water source, and the other end portion thereof is connected to the detergent supply apparatus 310, and thus wash water provided from the water source passes through the detergent supply apparatus 310.

A water valve is provided at one side of the water pipe to open or close a water line.

A control panel 303 is provided on a front upper portion of cabinet 301, and a power button 303*a*, a washing mode control dial 303*b*, a display unit that displays the washing mode 303*c* and an auxiliary control button 303*d*, and the like may be provided on control panel 303.

The washing mode may be divided into various modes, such as standard washing, stubborn dirt, baby clothes, affordable boiling, speed wash, allergy care, steam cleaning, functional clothing, quiet-quiet, color care, lingerie/wool, blanket, rinse+dehydration, and the like, for example.

The washing mode control dial 303*b* may be selectively set by a user's rotational manipulation, thereby performing the washing cycle with his or her desired washing method.

Detergent supply apparatus 310 may include a dispenser housing 350 and a detergent box 312.

Dispenser housing 350 may be installed within an front left upper end of cabinet 301.

Dispenser housing 350 may be installed adjacent to a left end portion of control panel 303.

Dispenser housing 350 provides an accommodation space capable of accommodating detergent box 312 therein.

Dispenser housing 350 may include an opening portion at a front side thereof, and may be configured with a sealed box structure capable of surrounding an outer circumference and a rear side of the detergent box 312.

Dispenser housing 350 may include a water distribution unit 330 at an upper end portion thereof.

Water distribution unit 330 may include a water cover 331 configured to cover the whole of an upper end portion of dispenser housing 350, and a distribution plate 332 provided with a water distribution passage therein.

Distribution plate 332 may be provided as an integral body at or detachably coupled to an upper end portion of dispenser housing 350.

A plurality of water supply ports 333 are provided at a rear side of distribution plate 332 to communicate with a water distribution passage, and a water pipe is connected to the water supply port 333, and thus wash water may be supplied to a water distribution passage of the distribution plate 332 from the water source.

A plurality of water supply holes are formed on a bottom surface of distribution plate 332, and wash water supplied through the water distribution passage can be supplied to the detergent storage unit through the water supply holes.

Detergent box 312 may be provided with a front plate 311 at a front side thereof, and a concave portion 311*a* is formed in a concave manner on a front surface of front plate 311 in an inward direction, and thus the user may insert his or her finger through the concave portion 311*a* to pull the front plate 311.

The detergent may divided into a powder detergent and a liquid detergent.

The powder detergent is typically widely used, but has a disadvantage that due to the characteristics of detergent, it becomes damp when moisture is brought into contact therewith, and detergent powder particles agglomerate with each other to block the liquid detergent outlet port 321 or the like.

On the other hand, liquid detergent has inconvenience that an adequate amount of liquid detergent should be taken out to be used in the liquid detergent storage unit 320 for each washing cycle.

According to the present disclosure, the advantage of the liquid detergent can be solved at once.

To this end, detergent supply apparatus 310 according to the present disclosure may include a liquid detergent storage unit 320 and a powder detergent storage unit 340 within detergent box 312.

Liquid detergent storage unit 320 and powder detergent storage unit 340 may be partitioned by a partition wall.

A cover plate 329*a* is provided on an upper surface of liquid detergent storage unit 320, and an inlet port may be provided at one side of the cover plate. An opening and closing plate 329*b* is coupled to one side of the cover plate in a hinge structure to open or close the inlet port.

In this case, the opening and closing plate 329*b* may be open when liquid detergent is additionally inserted into the liquid detergent storage unit 320, and the opening and closing plate 329*b* may be closed at normal times, thereby preventing wash water from flowing into the liquid detergent storage unit 320 from the water supply hole of the water distribution unit 330.

Here, the opening and closing plate 329*b* may be coupled to cover plate 329*a* in a slide manner rather than a hinge structure, and thus overlapped with cover plate 329*a* or spread from cover plate 329*a*, thereby opening or closing the inlet port of the liquid detergent storage unit 320.

Liquid detergent storage unit 320 may include a pumping device 322 and a discharge portion 323*c* to discharge an adequate amount of liquid detergent stored therein for each washing cycle.

Liquid detergent storage unit 320 may be a box structure horizontally placed within detergent box 312.

Pumping device 322 may be provided at a rear portion of liquid detergent storage unit 320.

Pumping device 322 may be implemented with a gear pump operated by a pair of gears 322*a*, 322*b*.

The gear pump may include a pair of gears 322*a*, 322*b* rotating in engagement with each other, and the gears 322*a*, 322*b* may rotate in opposite directions while being circumscribed with each other.

The gear pump may pump liquid detergent from one side to the other side by interposing the circumscribed gears 322*a*, 322*b* therebetween.

Liquid detergent outlet port 321 is provided on a bottom surface of an end portion of liquid detergent storage unit 320, and liquid detergent may be discharged to the outside through the liquid detergent outlet port 321.

The bottom surface of the liquid detergent storage unit 320 is formed to be inclined downward toward the liquid detergent outlet port 321.

In other words, liquid detergent storage unit 320 may be gradually inclined such that a height of the other bottom surface decreases as being close to the liquid detergent outlet port 321.

Due to this, liquid detergent stored in the liquid detergent storage unit 320 may be collected into the liquid detergent outlet port 321 by gravity, thereby efficiently maintaining the flow of liquid detergent.

Liquid detergent outlet port 321 may be formed to communicate with an inlet port of the gear pump.

The liquid detergent is discharged from the liquid detergent storage unit 320 through the liquid detergent outlet port 321 and supplied to the gear pump, and pumped by the gear pump to be discharged through discharge portion 323*c*.

Pumping device 322 may selectively discharge detergent discharged from outlet port 321.

The phrase "selectively discharge detergent by the pumping device 322" may denote that detergent supply is intermittently carried out.

For example, detergent will be pumped by pumping device 322 while pumping device 322 is driven, and thus in this case, detergent may be supplied to the tub, but detergent will not be pumped by pumping device 322 during a standby period in which the pumping device 322 is not driven, and thus in this case, detergent may not be supplied to the tub.

The selective supply of detergent by pumping device 322 is to intermittently supply detergent to the tub by the pumping device 322 rather than allowing a user to determine an adequate amount of liquid detergent to insert it into detergent box 312 for each washing cycle.

The amount of detergent pumped by pumping device 322 may be controlled by the rotational speed of the gear 322*a*, 322*b*.

As increasing the rotational speed of the gear pump, increases the speed of pumping and increases the amount of pumping.

Accordingly, an adequate amount of liquid detergent put into the tub for each washing cycle may be adjusted by controlling the rotational speed of the gear pump using a detergent supply control knob (or detergent supply control button) provided on control panel 303.

Pumping device 322 may include a passage forming plate 323 coupled to cover outlet port 321 of the liquid detergent storage unit 320.

Passage forming plate 323 may be disposed on a rear surface of the liquid detergent storage unit 320.

Passage forming plate 323 may include an inlet portion 323*a* disposed to face outlet port 321 of the liquid detergent storage unit 320.

Inlet portion 323*a* may be preferably located on a rear bottom surface of the liquid detergent storage unit 320 similarly to outlet port 321 of the liquid detergent storage unit 320.

It is because outlet port 321 and inlet portion 323*a* should be formed in a lowest position as possible to supply liquid detergent stored in the liquid detergent storage unit 320 as much as possible.

Passage forming plate 323 may include a supply passage 323*b* configured to connect one side of the gear pump of pumping device 322 and the other side thereof.

Supply passage 323*b* may connect inlet portion 323*a* and discharge portion 323*c*.

In this case, supply passage 323*b* may move detergent pumped by pumping device 322 to discharge portion 323*c* to pump the pumped detergent to the tub through the discharge portion 323*c*.

Pumping device 322 may be driven by drive unit 327.

Drive unit 327 may be a driving motor that generates a rotational force.

The driving motor may be installed on a rear surface of dispenser housing 350.

The driving motor may be accommodated into motor housing 328.

The driving motor may be fixed and coupled to an inside of cabinet 301 by a mounting bracket.

The driving motor may be controlled by receiving an electrical control signal from the detergent supply control knob.

The user may manually control a detergent quantity using the detergent supply control knob or automatically control the detergent quantity according to a preset default value for each washing mode.

The driving motor may receive three-phase AC power from the outside to generate a rotational force.

The rotational force generated from the driving motor may be output through driving shaft 326 protruded to an outside of motor housing 328.

Driving shaft 326 may be formed to be protruded from one end portion of motor housing 328, and protruded in an inward direction from a rear surface of dispenser housing 350.

Pumping device 322 may be connected to a driving motor through a coupler 325 to receive power.

Coupler 325 may include a driving gear 325*a* and a driven gear 325*b*.

Driving gear 325*a* may be rotatably coupled to driving shaft 326.

Driven gear 325*b* may be coupled to driving gear 325*a* in an engaged manner.

Both end portions of the gears 322*a*, 322*b* of the gear pump may be rotatably supported by a bearing provided between the passage forming plate 323 and a rear end portion of the liquid detergent storage unit 320.

Gears 322*a*, 322*b* of the gear pump may include the rotation shaft 322*b*', respectively.

The rotation shaft 322*b*' provided in either one 322*a*, 322*b* of the gears 322*a*, 322*b* of the gear pump may be formed in an elongated manner in an axial direction.

The length of rotation shaft 322*b*' may be formed in an elongated manner to pass through the thickness of the passage forming plate 323.

One end portion of the rotation shaft 322*b*' may be directly connected to a central portion of gear 322*b*, and the other end portion of the rotation shaft 322*b*' may be coupled to driven gear 325*b*.

Passage forming plate 323 may include a through hole for passing through rotation shaft 322*b'*.

A sealing member 324 may be provided around the through hole since liquid detergent may be leaked from the liquid detergent storage unit 320 through the through hole.

Sealing member 324 may surround the periphery of the through hole in a ring shape.

Sealing member 324 may be provided on a rear side of passage forming plate 323, namely, on a surface opposite to a surface facing the liquid detergent storage unit 320.

A sealing member supporting portion 323*d* may be protruded in a circular shape on a rear surface of the passage forming plate 323 to fix the sealing member 324.

Sealing member 324 has a circular shape, and may be inserted into the sealing member supporting portion 323*d* to seal a gap between the rotation shaft 322*b*' and the through hole.

Rotation shaft 322*b*' may be coupled to driven gear 325*b* through sealing member 324.

A pumping mechanism and a pumping operation of liquid detergent according to a connection relationship with the foregoing configuration will be described in detail.

As the driving motor is operated, driving shaft 326 protruded to an inner side of the dispenser housing 350 from motor housing 328 is rotated.

Next, driving gear 325*a* coupled to driving shaft 326 rotates, and driven gear 325*b* coupled to the driving gear 325*a* in an engaged manner rotates together therewith.

As driving gear 325*a* and driven gear 325*b* are rotated, power is transmitted to the gear pump which is a pumping device 322 through the rotation shaft 322*b*' passing through the passage forming plate 323.

One gear 322*b* of the gears 322*a*, 322*b* of the gear pump receives power from the rotation shaft 322*b*' to rotate, and the remaining gear 322*a* coupled to the gear 322*b* in an engaged manner is interlocked therewith to generate pumping power by the rotation of the gear 322*a*, 322*b*.

The liquid detergent may be supplied to the inlet side of the gear pump through inlet portion 323*a* of the passage forming plate 323 from outlet port 321 formed on a bottom surface of a rear end portion of the liquid detergent storage unit 320 by the pumping power, and the supplied liquid detergent may be compressed while passing through a pair of gears 322*a*, 322*b* in engagement with each other.

The compressed liquid detergent may be supplied to discharge portion 323*c* through supply passage 323*b* of the passage forming plate 323, and discharged downward from discharge portion 323*c*.

The discharged liquid detergent may be supplied to water passage 351 through a space portion 352 provided on a bottom surface of dispenser housing 350.

Space portion 352 may be provided between a lower surface of detergent box 312 and a bottom surface of dispenser housing 350.

Space portion 352 may be communicated with water passage 351 provided on a rear bottom surface of dispenser housing 350.

Water passage 351 may be connected to the tub through a bellows pipe.

The liquid detergent may be supplied to the tub through the bellows pipe.

Furthermore, liquid detergent discharged from discharge portion 323*c* may be mixed with wash water flowing into space portion 352 to supply wash water mixed with detergent to the tub.

Furthermore, the present disclosure may present a method of solving disadvantages of conventional powder detergents.

Liquid detergent storage unit 320 may be located at a rear side of the left lateral surface within detergent box 312 based on a frontal perspective of the washing machine.

Furthermore, a wash water input portion 334 may be provided at a front side of the liquid detergent storage unit 320 within detergent box 312.

Wash water is supplied to a wash water input portion 334 from a water source through the water supply hole of the water distribution unit 330, and thus directly supplied to the tub through the water passage 351.

Furthermore, wash water and liquid detergent inserted into the wash water input portion 334 may be mixed in space portion 352 between a lower surface of detergent box 312 and a bottom surface of dispenser housing 350, and thus wash water mixed with detergent may be supplied to the tub through water passage 351.

A water level sensor is provided within the liquid detergent storage unit 320, and thus when liquid detergent is insufficient, it may be additionally supplied to an inside of the liquid detergent storage unit 320 through an additional liquid detergent supply pipe or hose line.

Hereinafter, the movement path of liquid detergent in a detergent supply apparatus 310 according to still another embodiment of the present disclosure will be described with reference to FIG. 23.

Figure 23:
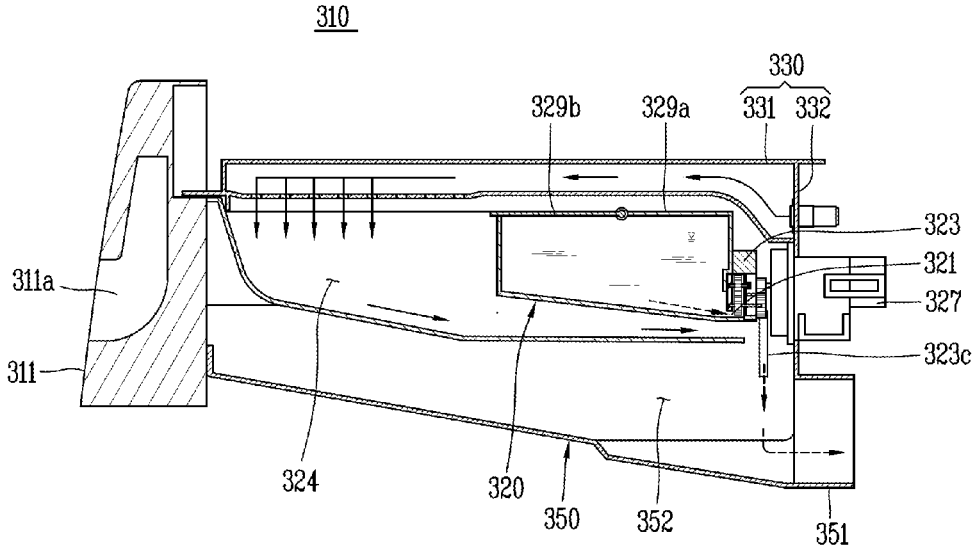
FIG. 23 is a cross-sectional view illustrating a liquid detergent movement path in a liquid detergent storage unit according to still another embodiment of the present disclosure.

FIG. 23 enclosed herein is a cross-sectional view illustrating a liquid detergent movement path in a liquid detergent storage unit 320 according to still another embodiment of the present disclosure.

The capacity of liquid detergent that can be stored in liquid detergent storage unit 320 is not a single doze but a capacity that is usable several times.

The method of supplying and inserting liquid detergent into liquid detergent storage unit 320 may include a method of allowing a user to manually inject liquid detergent into detergent box 312 and a method of automatically supplying liquid detergent from an external liquid detergent supply hose.

However, an automatic supply method due to the liquid detergent supply hose may be carried out by operating a water level sensor within the liquid detergent storage unit 320.

Liquid detergent stored in liquid detergent storage unit 320 may be supplied from the outlet port 321 formed on a rear surface of the liquid detergent storage unit 320 to inlet portion 323*a* of passage forming plate 323.

Subsequently, the liquid detergent supplied to inlet portion 323*a* of passage forming plate 323 is compressed while flowing between gears 322*a*, 322*b* engaged with each other in the gear pump.

The compressed liquid detergent may fall down to space portion 352 of dispenser housing 350 through discharge portion 323*c* of the passage forming plate 323 through supply passage 323*b*.

The fallen liquid detergent may be merged with wash water coming down from an upstream side of the wash water input portion 334, and supplied to the tub through water passage 351.

On the other hand, powder detergent storage unit 340 may be disposed in parallel with liquid detergent storage unit 320 by interposing a partition wall therebetween.

Furthermore, powder detergent storage unit 340 may be located at a rear side of the right lateral surface within detergent box 312.

Furthermore, an upper surface of powder detergent storage unit 340 may be open or an opening portion is formed on the upper surface thereof, wash water may fall down to the powder detergent storage unit 340 from the water supply hole of water distribution unit 330 through an open surface to be temporarily stored therein.

Powder detergent storage unit 340 may include a siphon tube 341 therein to prevent the detergent output port from being clogged by agglomerated powder detergent.

Siphon tube 341 may be protruded upward from the bottom surface within powder detergent storage unit 340 in which four lateral surfaces are all blocked.

A cover plate 342 covering an upper surface of powder detergent storage unit 340 may be provided at an upper portion of siphon tube 341.

An opening portion may be formed at one side of cover plate 342, and thus wash water may fall down through the opening portion from the water supply hole of water distribution unit 330.

A siphon cover tube 343 may be provided at the other bottom surface of cover plate 342 to cover siphon tube 341.

The diameter of siphon cover tube 343 is relatively greater than that of siphon tube 341.

Because of this, a siphon passage may be formed between an outer diameter surface of siphon tube 341 and an inner diameter surface of siphon cover tube 343.

Powder detergent inserted into powder detergent storage unit 340 and wash water supplied through the water supply hole of water distribution unit 330 may be mixed with each other.

The powder detergent may be a hydrophilic material that is easily soluble, regardless of in cold or hot water, and can be dissolved even if soaked for a while in water.

A predetermined period of time may be consumed until wash water supplied from the water supply hole of water distribution unit 330 fills up to the height of siphon tube 341, and for this period of time, powder detergent inserted into the powder detergent storage unit 340 can be dissolved in wash water.

In other words, since an internal space of the powder detergent storage unit 340 is sealed, for a predetermined period of time until wash water fills up to the height of siphon tube 341, detergent powder is soaked, mixed, and dissolved in wash water.

When the height of wash water dissolved with powder detergent increases to that of siphon tube 341, wash water containing detergent rises up along a siphon passage between siphon tube 341 and siphon cover tube 343 according to the siphon principle, and then falls down to an inside of siphon tube 341 from the apex.

Here, the siphon passage is sufficient for wash water dissolved with powder detergent to pass therethrough, but impossible for agglomerated powder detergent to pass therethrough.

Accordingly, siphon tube 341 may play a role of acceleration allowing powder detergent to be sufficiently dissolved in wash water, and siphon cover tube 343 and siphon tube 341 may prevent the inflow of agglomerated powder detergent.

Furthermore, in order to well dissolve the powder detergent in wash water, an agitator may be provided within powder detergent storage unit 340.

The agitator may be rotated using the flow of fluid like a pinwheel or waterwheel.

The agitator may be implemented by a bucket rotating in a vertical direction and the rotation shaft 322*b*' supporting this.

The agitator may rotate using the potential energy of wash water falling down from the water supply hole of the water distribution unit 330.

For example, the falling wash water may be soaked in a bucket to agitate wash water while rotating the bucket.

Due to this, powder detergent may be effectively dissolved in wash water with no agglomeration.

A water level sensor may be provided within powder detergent storage unit 340 to supply wash water to the powder detergent storage unit 340, thereby maintaining wash water above the height of siphon tube 341.

Hereinafter, the movement path of powder detergent disclosed in the present disclosure will be described with reference to FIG. 24.

Figure 24:
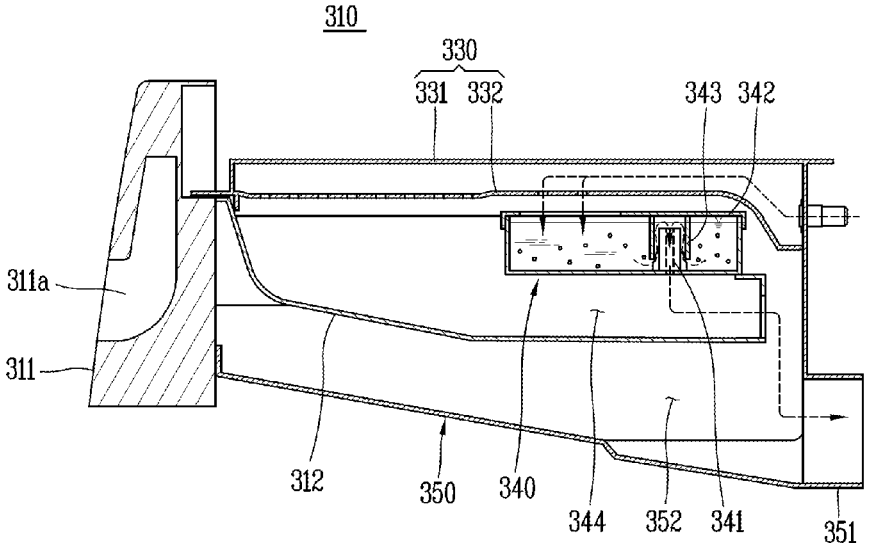
FIG. 24 is a cross-sectional view illustrating a movement path of wash water in which powder detergent is dissolved in a powder detergent storage unit according to still another embodiment of the present disclosure.

FIG. 24 is a cross-sectional view illustrating a movement path of wash water in which powder detergent is dissolved in a powder detergent storage unit 340 according to still another embodiment of the present disclosure.

Since the powder detergent is a solid material due to the characteristics of detergent, the powder detergent may be dissolved in water and supplied to the tub.

The user may withdraw detergent box 312 to a front side of cabinet 301, and then insert an adequate amount of detergent powder into powder detergent storage unit 340.

Wash water may be supplied to a water distribution passage of water distribution unit 330 from a water source, and wash water distributed through the water distribution passage may be inserted into the powder detergent storage unit 340 through the water supply hole formed on a bottom surface of distribution plate 332.

Wash water inserted from the water supply hole may flow into powder detergent storage unit 340 through the opening portion formed on an upper cover plate 342 of powder detergent storage unit 340.

Wash water flowed into powder detergent storage unit 340 may be mixed with powder detergent, and the powder detergent may be dissolved in wash water.

As the amount of detergent liquid (hereinafter, detergent liquid) dissolved with powder detergent gradually increases in powder detergent storage unit 340, detergent liquid moves to the apex of siphon tube 341 through a siphon passage between siphon cover tube 343 and siphon tube 341 when the height of detergent liquid increases to that of siphon tube 341.

Subsequently, the detergent liquid falls down along the tube while flowing into the tube at the apex of siphon tube 341.

The detergent liquid fallen down along siphon tube 341 falls down to detergent liquid drain path 344, and flows down to a bottom surface of the detergent box 312, and as a result, the detergent liquid is supplied to the tub through water passage 351 of dispenser housing 350.

Consequently, according to the present disclosure, pumping device 322 provided in liquid detergent storage unit 320 may be selectively driven, and thus an adequate amount of liquid detergent may not be determined by a user, but may be automatically set and supplied from detergent supply apparatus 310, and a user may set his or her desired amount as needed, thereby avoiding inconvenience during the supply of detergent in the related art.

Furthermore, siphon tube 341 may be provided in powder detergent storage unit 340, and powder detergent and wash water may be temporarily stored in a sealed space until powder detergent is sufficiently dissolved in wash water, and wash water dissolved with powder detergent may be supplied above the height of siphon tube 341.

Additionally, a passage of siphon tube 341 and siphon cover tube 343 through which detergent liquid passes may be decreased, thereby preventing agglomerated powder detergent from being clogged in outlet port 321 in the related art.

Though the foregoing embodiments are applicable to a case where the technical concept of the present disclosure is applied to a washing machine, they may not be necessarily limited to this, and also applicable to a washing machine having a drying function or the like.

What is claimed is:

1. A washing machine, comprising:

a cabinet having an inlet port formed at a front panel for laundry insertion thereinto and a door configured to open or close the inlet port;

a tub within the cabinet for storing wash water;

a drum in communication with the inlet port, and rotatably provided within the tub;

a detergent dispenser provided below the inlet;

a water passage to supply wash water from a water source to at least one of the tub and the detergent dispenser;

a connecting passage to connect the tub and the detergent dispenser for transfer of the wash water stored in the tub to the detergent dispenser and for transfer of the detergent stored in the detergent dispenser to the tub; and a circulation pump circulating wash water discharged from a bottom surface of the tub or wash water mixed with detergent to the tub, wherein the detergent dispenser comprises an automatic detergent supply unit, wherein the connecting passage comprises:

a first detergent supply passage connecting a bottom surface of the tub and the circulation pump;

a connecting pipe connected to the detergent dispenser; and a second detergent supply passage connecting the detergent dispenser and at least another part of the tub, wherein the at least another part of the tub, where the second detergent supply passage is connected, is placed on a position higher than the detergent dispenser, and the at least another part of the tub is communicated with an inner portion of the tub, and wherein detergent discharged from the bottom surface of the tub is circulated via the detergent dispenser through the first and second detergent supply passages to the at least another part of the tub, and wherein the automatic detergent supply unit comprises:

at least a container storing the detergent and provided with an outlet port at a bottom surface of the container;

a container receiving portion provided in the cabinet to detachably receive the container;

a gear pump mounted onto the bottom surface of the container to selectively discharge the detergent from the bottom surface of the container by a predetermined amount;

a drive unit provided in the container receiving portion to be separated from the gear pump, the drive unit driving the gear pump; and a coupler configured to connect the drive unit and the gear pump, and the coupler transferring power from the drive unit to the gear pump when the container is received within the container receiving portion.

2. The washing machine of claim 1, wherein the gear pump discharges detergent in the automatic detergent supply unit to at least one of the first and the second detergent supply passages.

3. The washing machine of claim 1, wherein the container receiving portion comprises:

a mounting portion on which the container is mounted;

a water supply port to receive wash water thereinto;

an internal passage communicated with the water supply port to flow detergent discharged by the gear pump to be mixed with wash water; and a water drain port communicated with the internal passage to discharge the wash water mixed detergent.

4. The washing machine of claim 1, wherein the gear pump comprises a first gear and a second gear rotatably mounted on the bottom surface of the container to be coupled to each other in an engaged manner.

5. The washing machine of claim 1, wherein the detergent dispenser comprises:

a dispenser case having an opening portion on an upper surface thereof; and a detergent supply unit mounted on the dispenser case to store detergent therein.

6. The washing machine of claim 5, wherein the dispenser case is rotatably provided on a front portion of the cabinet, and rotates between an opening position at which the opening portion is exposed to the outside and an accommodation position at which the opening portion is accommodated into the cabinet.

7. The washing machine of claim 6, wherein the dispenser case forms the whole or part of a lower panel located lower than the inlet port on a front panel of the cabinet.

8. The washing machine of claim 5, wherein the detergent supply unit further comprises a manual detergent supply unit.

9. The washing machine of claim 8, wherein the automatic detergent supply unit comprises a level sensing device to sense the remaining amount of detergent.

10. The washing machine of claim 9, wherein the level sensing device comprises:

a pair of electrodes an end portion of which is exposed to an inside of the container;

a container-side connecting terminal connected to the pair of electrodes, and disposed on a bottom surface of the container; and a receiving-portion-side connecting terminal provided in the container receiving portion to be brought into contact with the container-side connecting terminal.

11. The washing machine of claim 8, wherein a pump module is provided within the cabinet, and the pump module further comprises a drain pump to discharge wash water, or wash water mixed with detergent that has passed through the tub, outside of the cabinet.

12. The washing machine of claim 11, wherein the first detergent supply passage is configured to supply detergent from the detergent dispenser to the bottom surface of the tub, and wherein the detergent mixed with the wash water is supplied from the detergent dispenser into the bottom surface of the tub via the first detergent supply passage by a pressure of the wash water which is supplied from the water source.

13. The washing machine of claim 12, wherein a detergent inlet port is provided on a bottom surface of the tub to flow detergent thereinto.

14. The washing machine of claim 12, wherein detergent in at least one of the automatic detergent supply unit and the manual detergent supply unit is supplied to the bottom surface of the tub through the first detergent supply passage.

15. The washing machine of claim 12, wherein detergent in at least one of the automatic detergent supply unit and the manual detergent supply unit is supplied to the at least another part of the tub through the second detergent supply passage.

16. The washing machine of claim 12, further comprising:

a drain passage connecting the tub, the drain pump, and an outside of the cabinet to drain wash water within the tub to the outside of the cabinet, wherein the drain passage connecting the tub and the drain pump, is commonly used with part of the first detergent supply passage.

17. The washing machine of claim 12, wherein the connecting pipe connecting the circulation pump and a water supply port of the automatic detergent supply unit to transfer wash water that has passed through the manual detergent supply unit to the water supply port of the automatic detergent supply unit.

18. The washing machine of claim 12, wherein the manual detergent supply unit comprises:

a distribution plate provided at an upper portion of the dispenser case to distribute wash water;

a detergent input portion provided with an input space to receive detergent and a water outlet port on a lower surface thereof, and disposed at a lower portion of the distribution plate to receive the wash water;

a hopper portion provided at a lower portion of the detergent input portion to temporarily store wash water falling down through the water outlet port; and an extension portion extended downward from the hopper portion to discharge wash water or wash water mixed with detergent.

19. The washing machine of claim 18, wherein the extension portion comprises a backflow prevention device connected to the first detergent supply passage to block wash water discharged from the tub from flowing back to the detergent dispenser.

20. The washing machine of claim 18, wherein the water outlet port is formed at a lower rear portion of the detergent input portion, and a lower surface of the detergent input portion is inclined downward as being close to the water output port, and disposed such that a portion formed with the water outlet port is higher than the remaining portion thereof when the detergent dispenser is rotated to an open position.

21. The washing machine of claim 12, wherein the water passage comprises at least one of:

a first water passage connecting the water source and the tub in order to supply wash water from the water source to the tub; and a second water passage connecting the water source and the detergent dispenser in order to supply wash water from the water source to the detergent dispenser, wherein a water valve is provided in at least one of the first water passage and second water passage.

22. The washing machine of claim 21, wherein the manual detergent supply unit further comprises a first manual detergent supply unit detergent supply passage including a backflow prevention device to block wash water discharged from the tub from entering the manual detergent supply unit.

23. The washing machine of claim 22, wherein the first water passage is disposed at a higher position than the backflow prevention device.

24. The washing machine of claim 22, wherein wash water supplied from the water source to the tub is supplied through the second water passage to fill the level of the tub up to a height of the backflow prevention device, and then supplied through the first water passage.

* * * * *